US007748082B2

(12) United States Patent
Harald et al.

(10) Patent No.: US 7,748,082 B2
(45) Date of Patent: Jul. 6, 2010

(54) DAMPER ARRANGEMENT

(75) Inventors: Sutterlütti Harald, Fussach (AT); Herbert Isele, Lustenau (AT)

(73) Assignee: Julius Blum GmbH, Hochst (AT)

( * ) Notice: Subject to any disclaimer, the term of this patent is extended or adjusted under 35 U.S.C. 154(b) by 0 days.

(21) Appl. No.: 12/078,783

(22) Filed: Apr. 4, 2008

(65) Prior Publication Data

US 2008/0209674 A1 Sep. 4, 2008

Related U.S. Application Data

(63) Continuation of application No. PCT/AT2006/000403, filed on Oct. 4, 2006.

(30) Foreign Application Priority Data

Oct. 6, 2005 (AT) ..... A 1635/2005

(51) Int. Cl.
*E05F 5/00* (2006.01)

(52) U.S. Cl. ..... 16/286; 16/296; 16/280

(58) Field of Classification Search ..... 16/286, 16/296, 277, 280, 54, 50; 188/266.6, 290
See application file for complete search history.

(56) References Cited

U.S. PATENT DOCUMENTS

| | | | | |
|---|---|---|---|---|
| 7,096,535 | B2 * | 8/2006 | Lin | 16/287 |
| 2003/0200625 | A1 * | 10/2003 | Zimmer | 16/306 |
| 2004/0093693 | A1 * | 5/2004 | Salice | 16/354 |
| 2004/0181903 | A1 * | 9/2004 | Salice | 16/82 |
| 2005/0246863 | A1 * | 11/2005 | Chesworth et al. | 16/221 |
| 2006/0026792 | A1 * | 2/2006 | Brustle et al. | 16/54 |
| 2009/0119876 | A1 * | 5/2009 | Pecar et al. | 16/293 |

FOREIGN PATENT DOCUMENTS

| | | |
|---|---|---|
| DE | 25 11 993 | 10/1976 |
| DE | 26 39 925 | 3/1978 |
| DE | 201 21 164 | 6/2002 |
| DE | 102 54 375 | 11/2003 |
| EP | 1 538 293 | 6/2005 |
| GB | 2 406 879 | 4/2005 |
| WO | 2005/095742 | 10/2005 |
| WO | 2006/088435 | 8/2006 |

OTHER PUBLICATIONS

International Search Report issued Jan. 19, 2007 in the parent International (PCT) Application corresponding to the present application. Austrian Search Report issued Feb. 21, 2006 in the corresponding Austrian patent application.

* cited by examiner

*Primary Examiner*—Victor Batson
*Assistant Examiner*—Rowland D Do
(74) *Attorney, Agent, or Firm*—Wenderoth, Lind & Ponack, L.L.P.

(57) ABSTRACT

A damper arrangement is provided for parts of furniture that can be pivoted in relation to each other. The arrangement includes at least one damper having a linear damping course, and at least two abutment parts which can be respectively fixed to one of the parts of the furniture, or can be supported thereon in an especially sliding manner. The abutment parts are interconnected in such a way that they can be pivoted by at least one articulated axis. The damper is arranged in such a way that the direction of the linear damping course thereof is at an angle to a parallel line, deviating (offset) from a vertical line, preferably essentially parallel to the articulated axis.

30 Claims, 36 Drawing Sheets

1
2
3
4
5
6
7
8
8'
9
11
14

DAMPER ARRANGEMENT

This application is a continuation of International Application No. PCT/AT2006/000403, filed Oct. 4, 2006.

BACKGROUND OF THE INVENTION

The invention concerns a damper arrangement for parts of an article of furniture, which are pivotable relative to each other. The arrangement includes at least one damper with a linear damping stroke and at least two abutment portions which can be respectively fixed to one of the parts of said article of furniture or which can be in particular slidably supported thereon and which are pivotably connected together by way of at least one hinge axis.

Generic damper arrangements for pivotable parts of an article of furniture, in the state of the art, always involve a requirement for an amount of space which is undesirably high, for the damper and its housing as well as the space required for the damping stroke movement.

The object of the invention is to reduce that requirement for space.

SUMMARY OF THE INVENTION

According to the invention, the object is achieved in that the damper is arranged so that the direction of its linear damping stroke is arranged at an angle, that differs from a perpendicular, relative to a parallel line, preferably substantially parallel, with respect to the hinge axis.

The damper arrangement according to the invention in such a fashion that the direction of the linear damping stroke of the damper does not run along a perpendicular as measured in relation to a line parallel with respect to the hinge axis affords in particular a reduction in the space required for the damping stroke. It can preferably be provided in that respect that the damper is arranged so that the direction of its linear damping stroke is arranged at an angle of at least 45°, preferably at least 60°, as measured in relation to a perpendicular to a parallel with respect to the hinge axis. For an optimum space saving, however, it is particularly beneficial if the direction of the linear damping stroke is arranged substantially parallel to the hinge axis.

The dampers with a linear damping stroke may initially involve per se known linear dampers. The invention can also be carried into effect, however, with rotational or other dampers with a linear damping stroke. It is beneficial for the damper arrangement according to the invention to be integrated into a hinge, preferably a furniture hinge. That is achieved for example by the abutment portions and the hinge axis of the damper arrangement being parts of a hinge. In that case, the abutment portions can be respectively secured or fixed to the parts of the article of furniture which are pivotable relative to each other. However, damper arrangements are also known in which at least one abutment portion cannot be fixed to the part of the article of furniture but can only be supported against the part, in particular in a sliding relationship. That situation does not involve hinges, even if the configuration of the abutment portions can otherwise be very similar to the situation in relation to hinges or furniture hinges. It is particularly frequently provided that one of the abutment portions is like a hinge cup and/or one of the abutment portions is like a hinge arm. That applies both in regard to the damper arrangements which are integrated into a hinge and also to the damper arrangements which are separate from a hinge.

If a hinge cup is provided as one of the abutment portions, the damper can beneficially be arranged on that abutment portion.

By virtue of the arrangement according to the invention of the dampers, it is beneficial to provide a transmission mechanism which, during pivotal movement of the abutment portions, transmits the movement of at least one hinge lever which pivotably connects the abutment portions together, to the damper, and thus produces the damper stroke. The transmission mechanism can also be advantageously arranged on an abutment portion which is of a hinge cup-like configuration.

BRIEF DESCRIPTION OF THE DRAWINGS

Various design configurations of the invention and in particular various types of transmission mechanisms are described below with reference to the specific description and drawings. In the drawings.

DETAILED DESCRIPTION OF THE INVENTION

Figure 1:
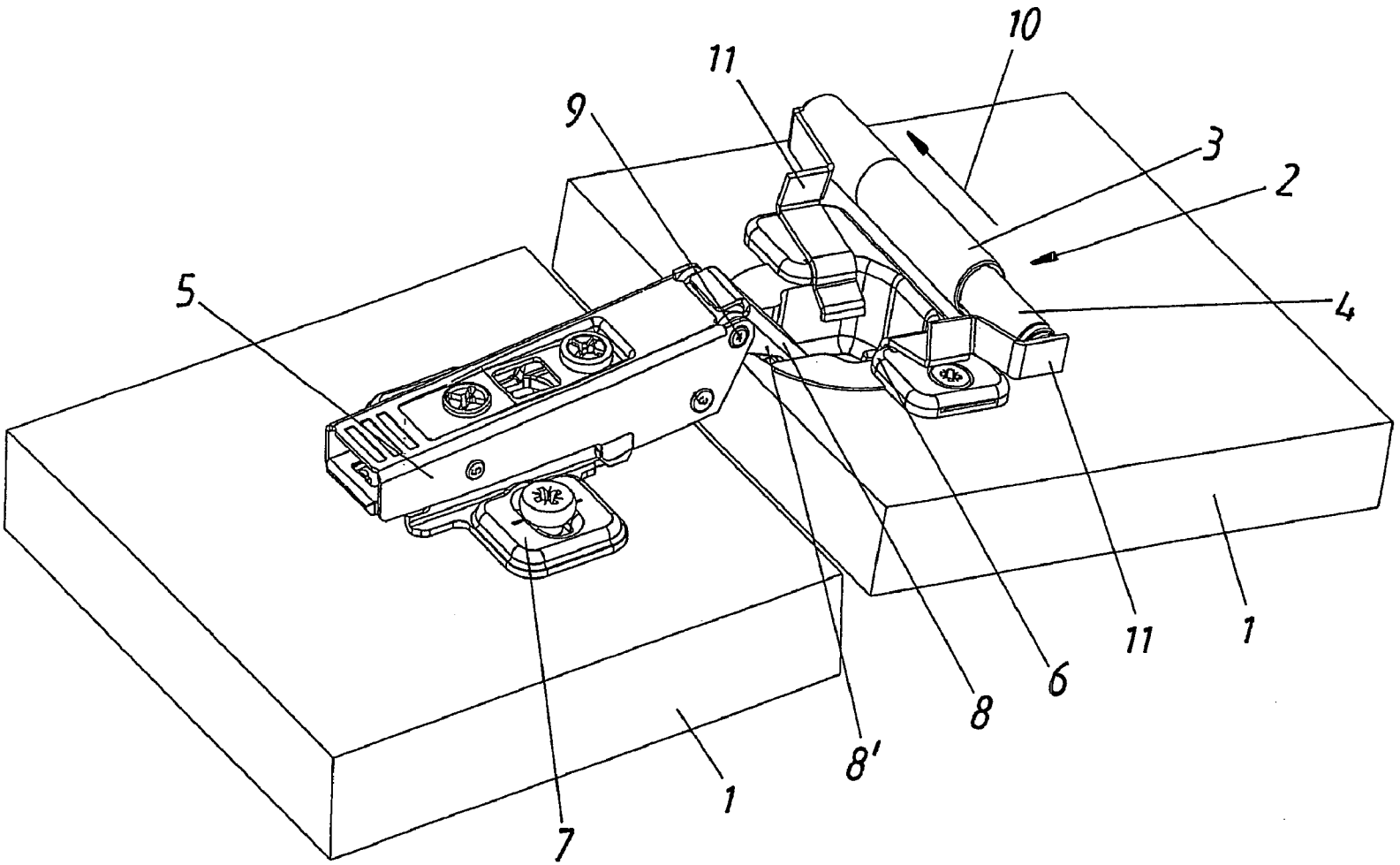
FIGS. 1 through 5*b* show a first embodiment by way of example of the invention.

All illustrated embodiments are damper arrangements which are integrated into furniture hinges. The furniture hinges on which this arrangement is based are known per se and are not described in detail. The description concentrates on the features according to the invention. In almost all illustrated embodiments, the direction (i.e., line of movement) 10 of the damping stroke of the damper 2 to be parallel to a hinge axis 9 and thus to all hinge axes 9. This, however, does not mean that the invention would be restricted thereto. Other orientations of the direction 10, 10', 10" of the damping stroke (i.e., line or axis along which damping movement occurs), which differ from the perpendicular 36 to a parallel 37 to the hinge axes 9 are also possible (see in that respect FIGS. 29 through 31 and 43). In the first five embodiments of the invention according to FIGS. 1 through 22 as also in the last three embodiments of the invention according to FIGS. 29 through 42, the damping stroke takes place when the damper 2 is compressed. In that situation, the pusher 4 or the piston rod 34 is pushed into the housing 3 of the damper 2. In the sixth embodiment as shown in FIGS. 23 through 28, the damping stroke takes place when the pusher 4 and the housing 3 of the damper 2 are pulled away from each other. In all embodiments, the return springs 33 of the dampers 2, which are provided as standard in the dampers 2 known in the state of the art and which here are only in part explicitly illustrated in the specific embodiments are used for the return movement. As a departure from the illustrated embodiments, however, it is also possible to use additionally existing elastic elements or springs for the return movement in opposite relationship to the direction 10.

Figure 2:
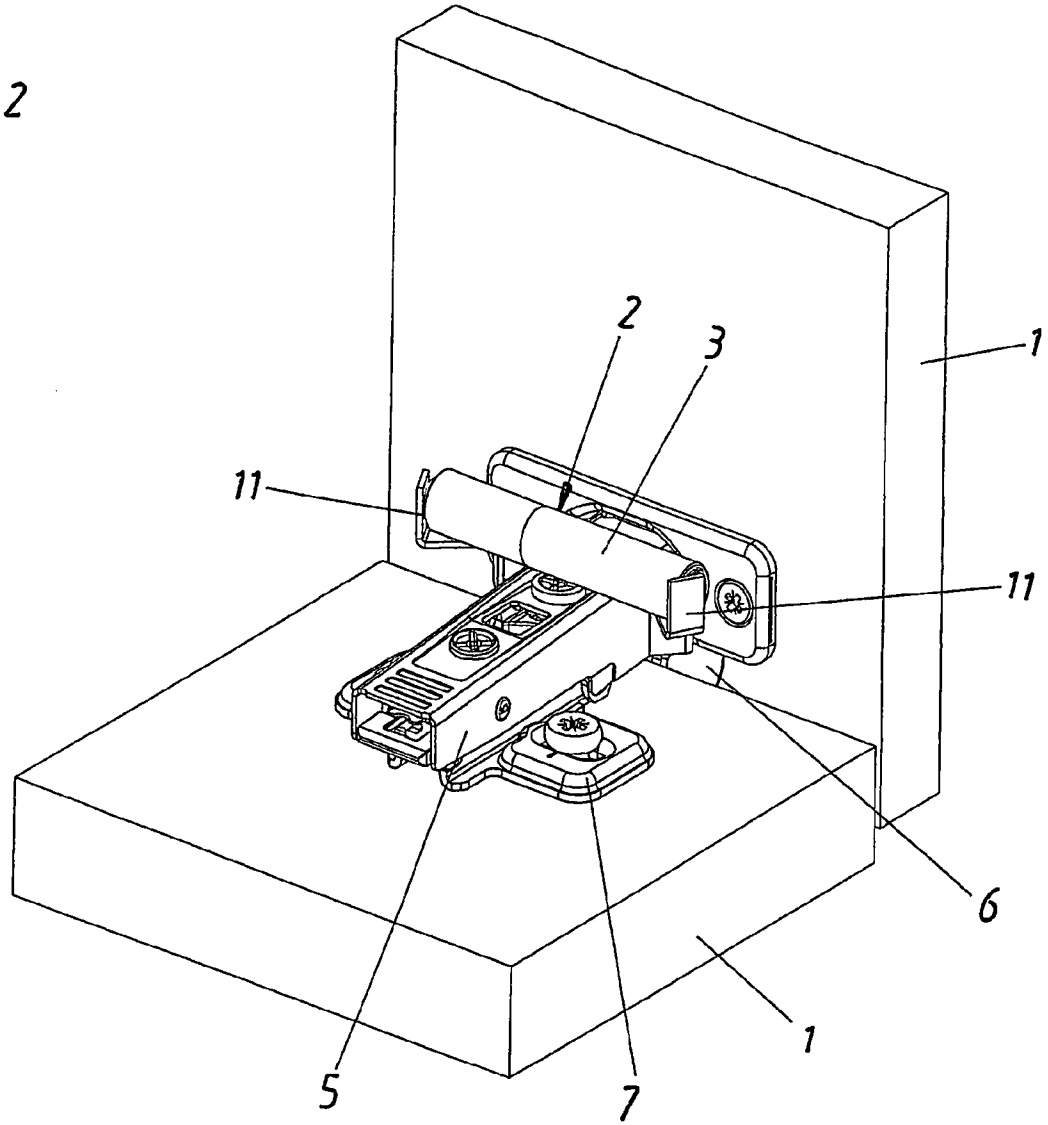
Figures 3, 3A:
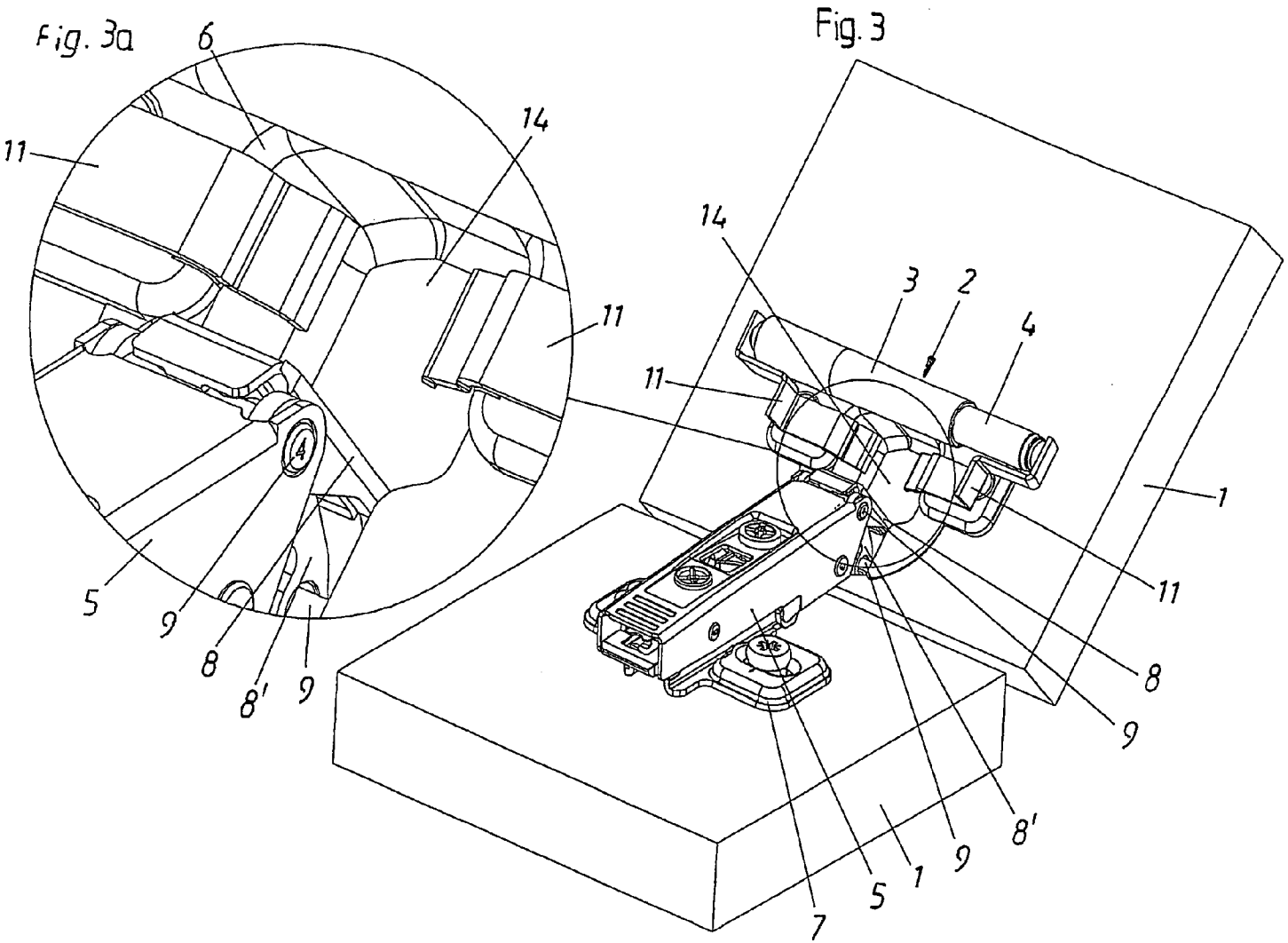
Figure 4:
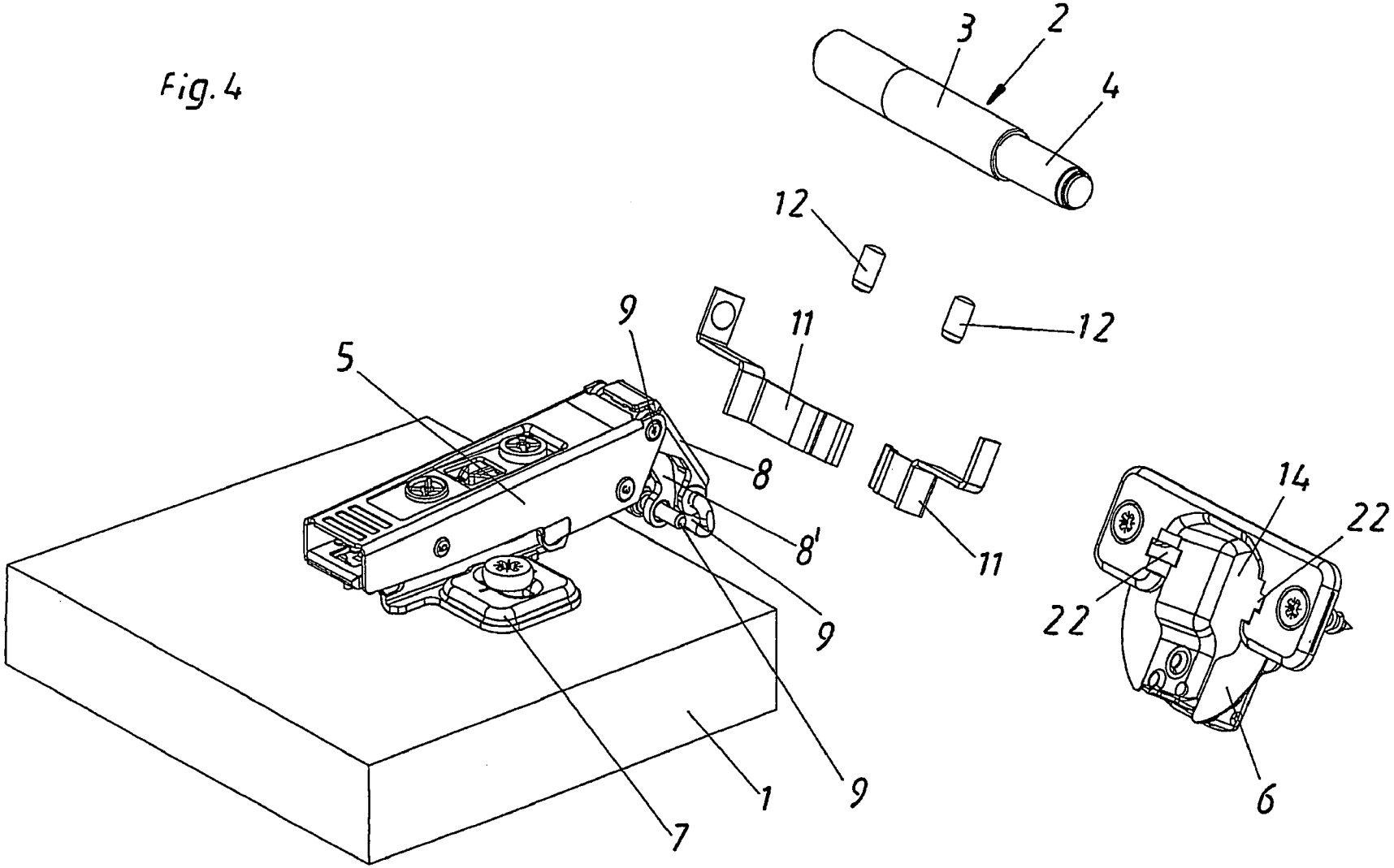
Figure 5:
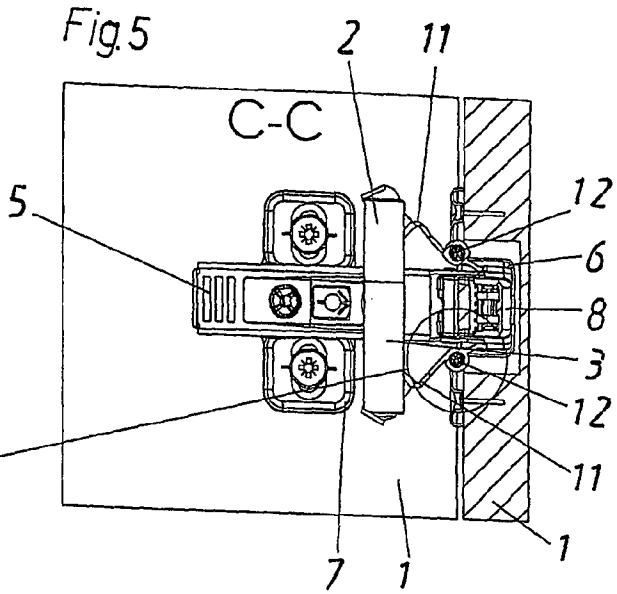
Figure 5A:
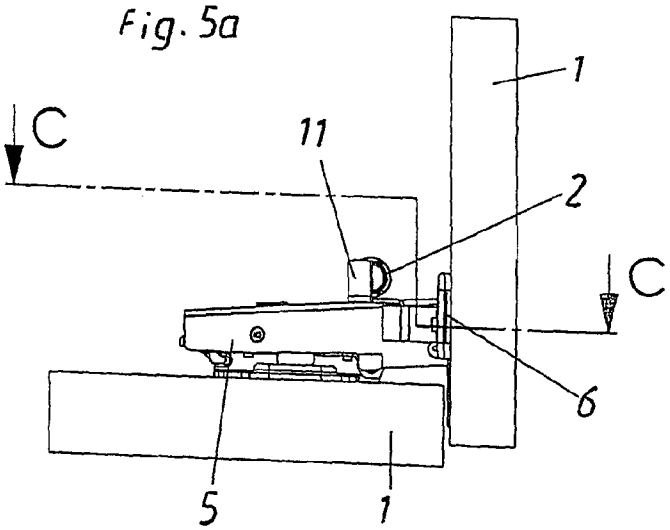
Figure 5B:
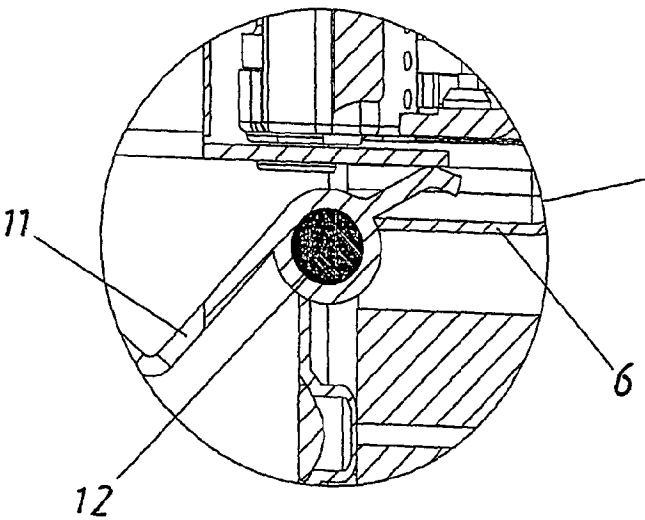
Figure 6:
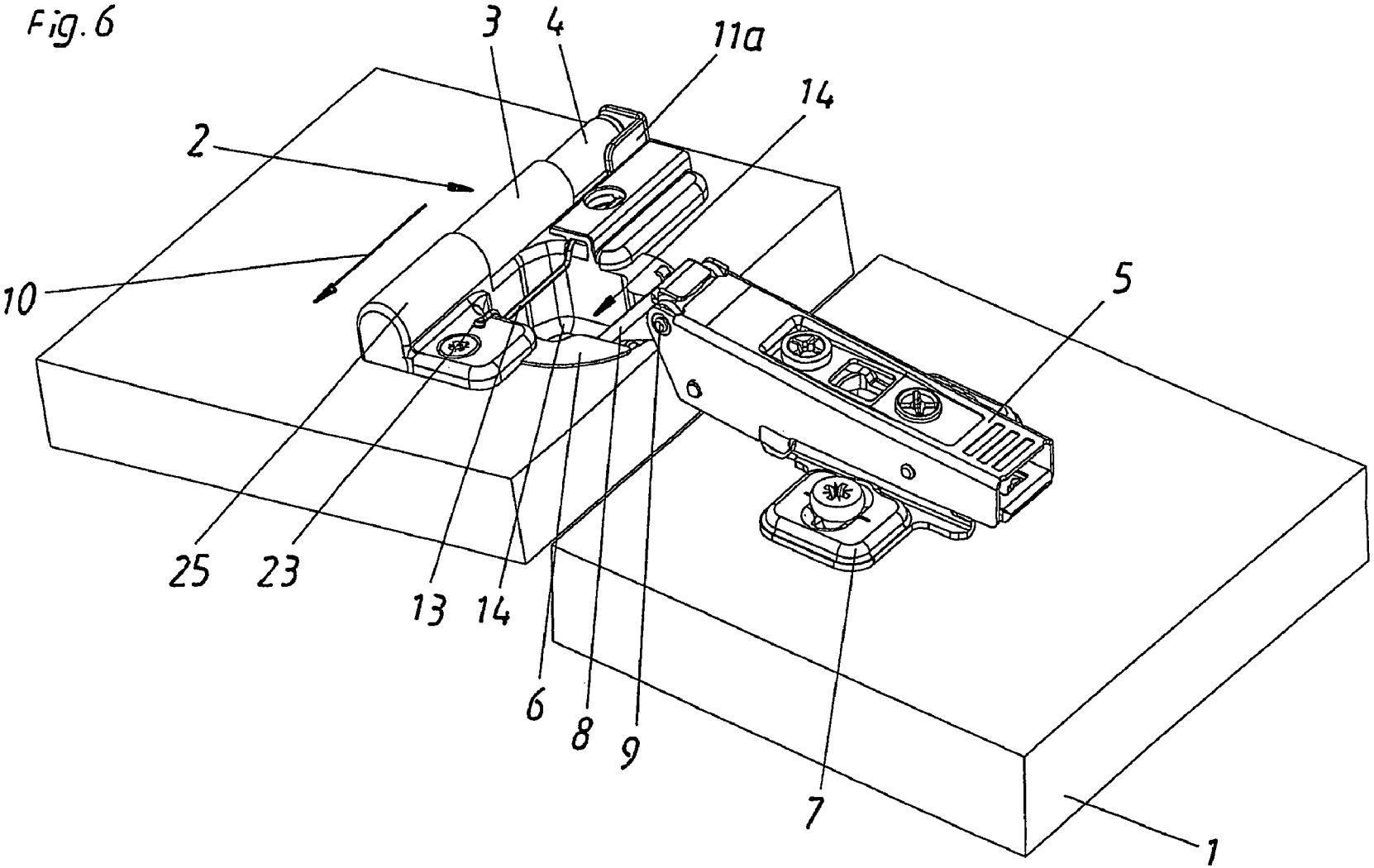
FIGS. 6 through 9 show a second embodiment by way of example of the invention.
Figure 7:
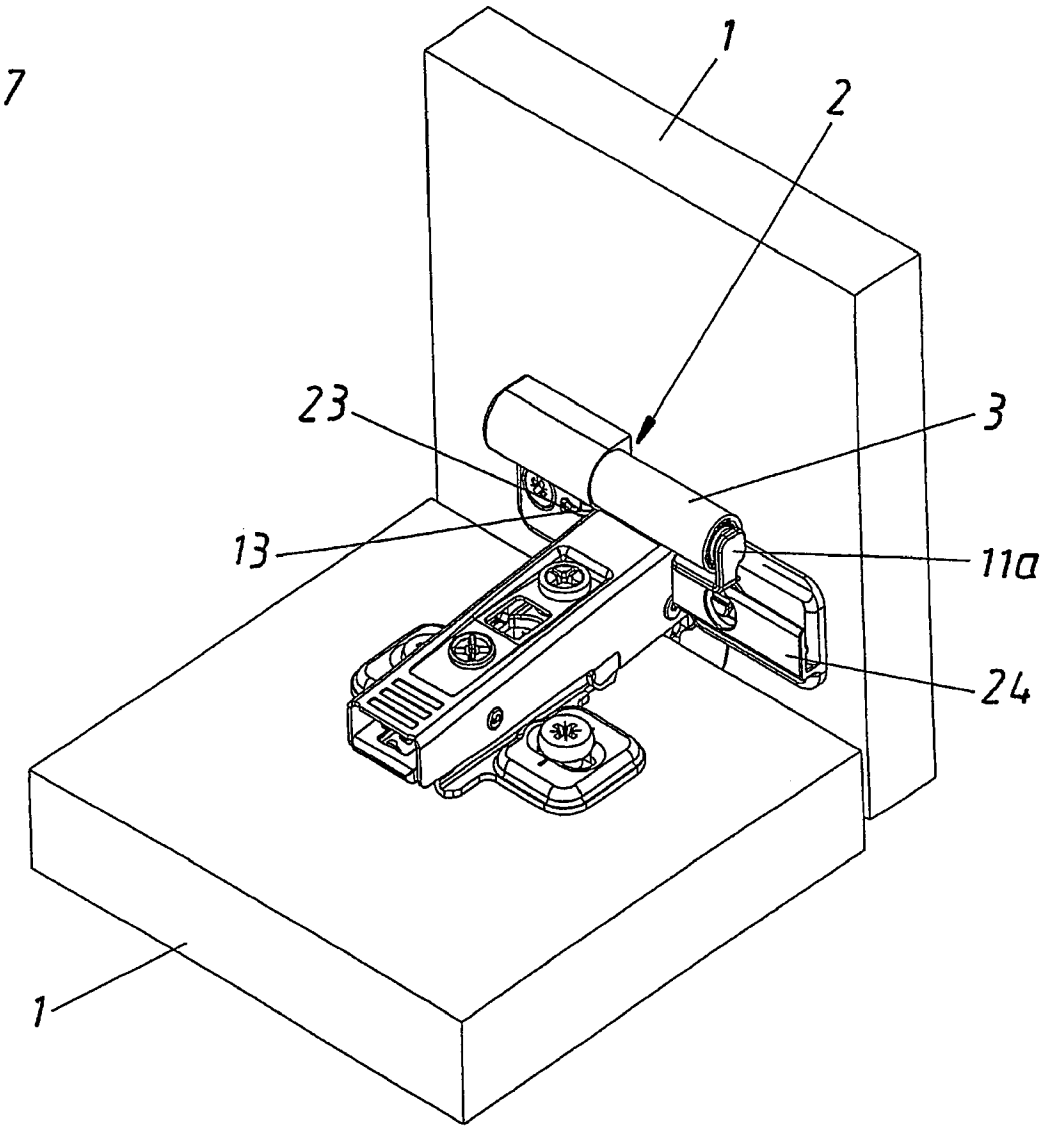

In the first embodiment of the invention shown in FIGS. 1 through 5*b*, two transmission levers 11 which are pivotable relative to each other are supported pivotably by means of a respective hinge axis 12 in openings 22 in the hinge cup 6. On one side of the pivot axes 12, the transmission levers 11 respectively engage the corresponding components 3 and 4 of the damper 2. On the respective other side with respect to the pivot axes 12, the transmission levers 11 are actuated by the outer hinge lever 8 of the furniture hinge from a closure position which is dependent on the geometry of the transmission levers 11. FIG. 1 shows the open position of the hinge. FIG. 2 shows the complete closure position in which the pusher 4 is pushed completely into the housing 3 of the damper 2 after the damping stroke has occurred. In the state of the art, the inner hinge lever 8' is known as an additional hinged connection between the hinge cup 6 and the hinge arm 5. The hinge arm 5 itself can be releasably clipped on to a base plate 7 by way of a clipping mechanism which is also known. The axes 12 of the transmission levers 11 are arranged in a direction parallel to a perpendicular to the hinge axes 9. In a deviation of the illustrated embodiment, it would also be conceivable for example to provide only one pivotably mounted transmission lever 11. That would then actuate one of the damper components 3 and 4 while the other damper component would be held by a support means rigidly fixed to the hinge cup 6. The exploded view of FIG. 4 particularly clearly shows the individual parts in an exploded condition. FIG. 5*a* shows a side view, where the angled section line CC is apparent. The section produced on CC is shown in FIG. 5 for the closure position. The detail in FIG. 5, which is identified by a circle, is shown on an even larger scale in FIG. 5*b*.

Figure 8:
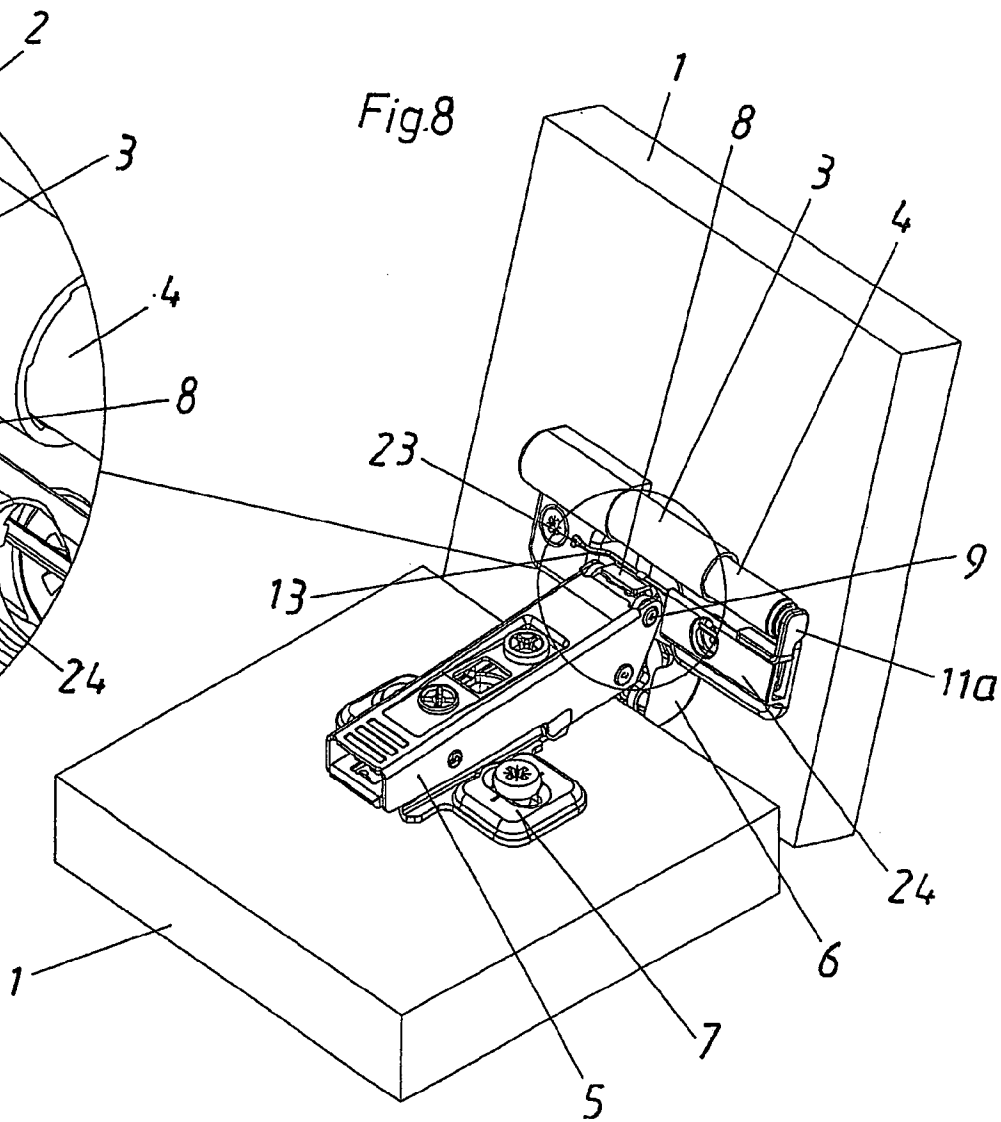
Figure 8A:
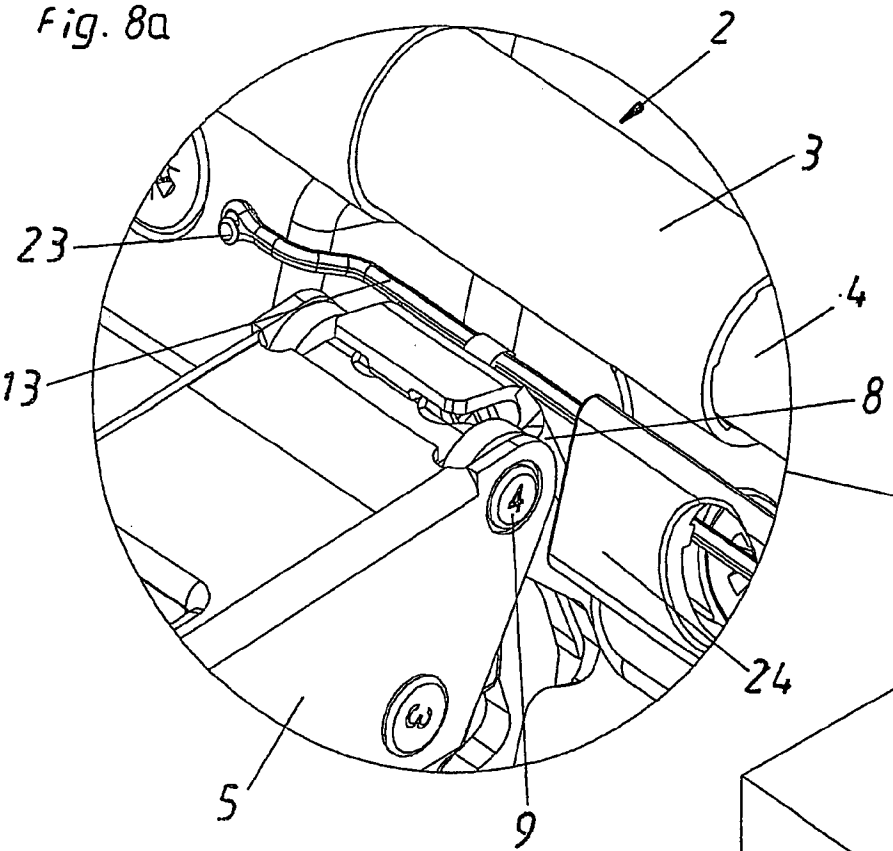
Figure 9:
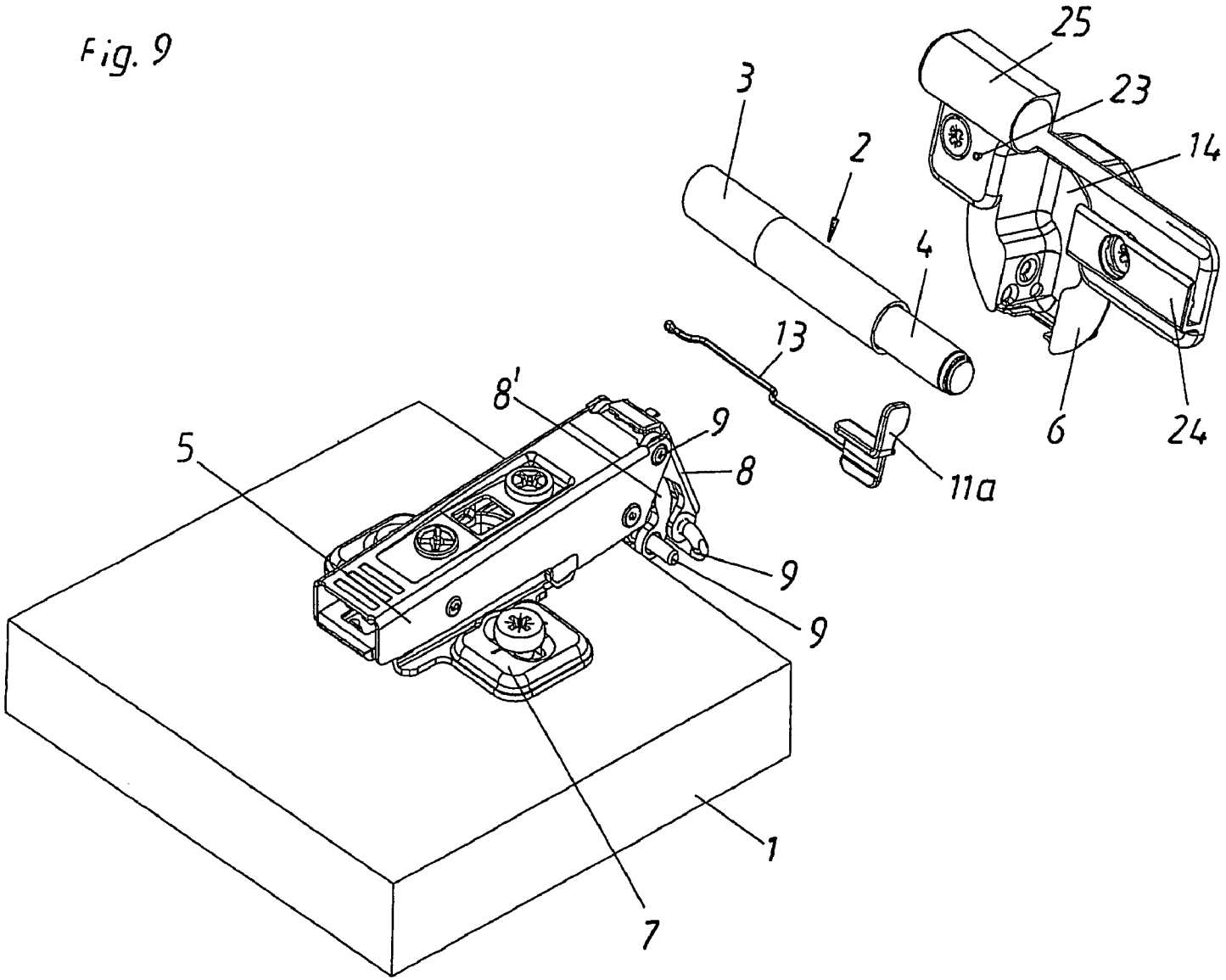
Figure 10:
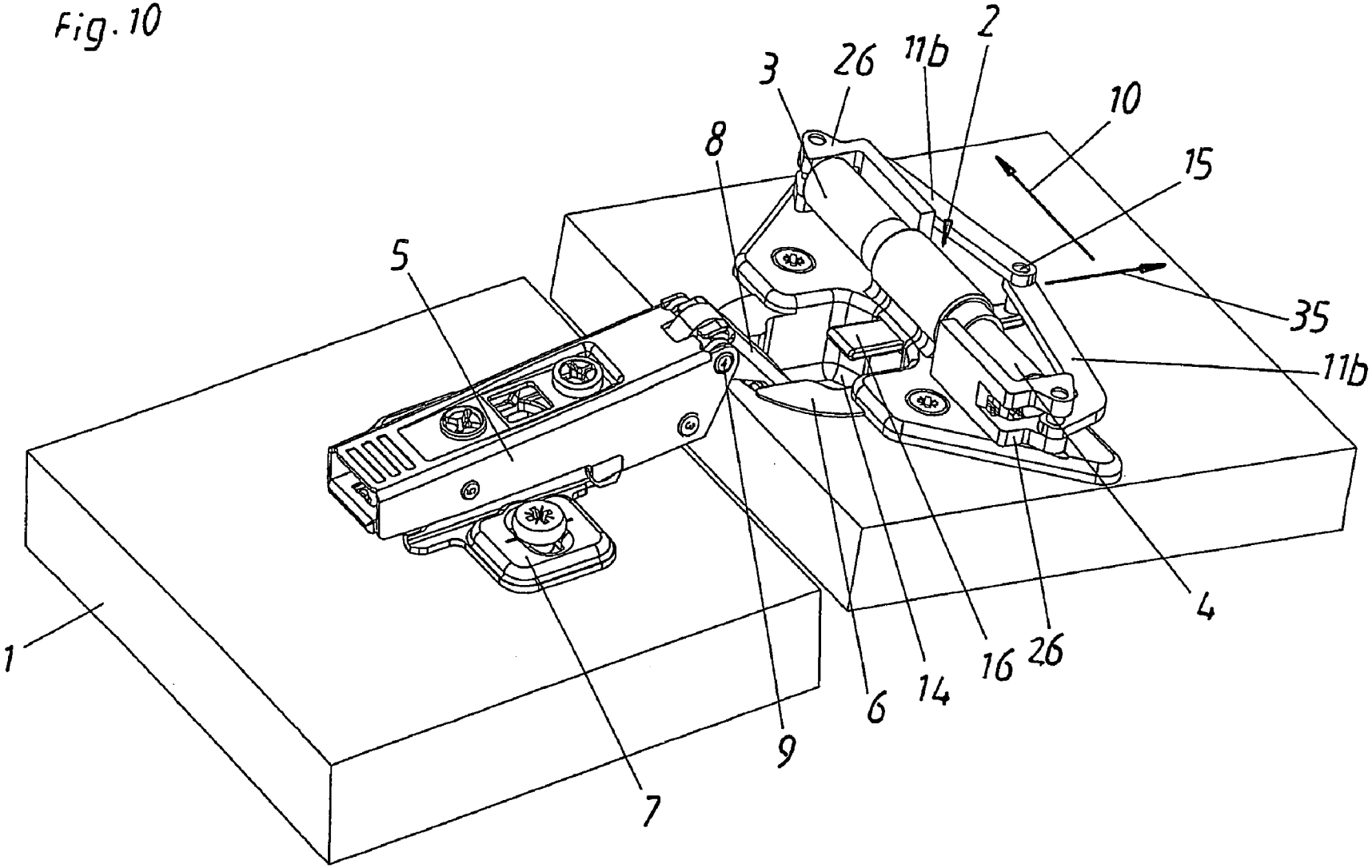
FIGS. 10 through 13 show a third embodiment by way of example of the invention.
Figure 11:
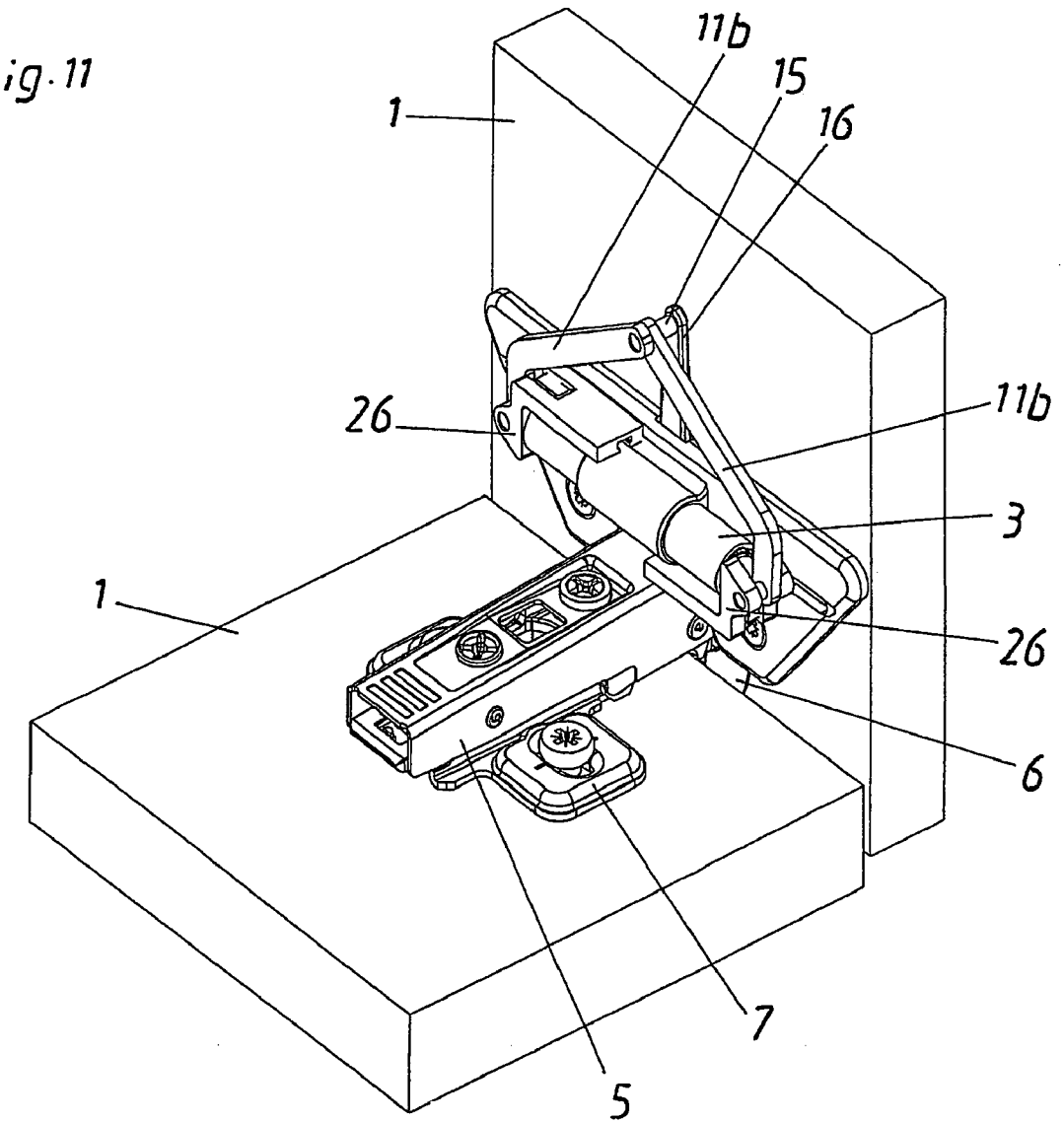
Figure 12:
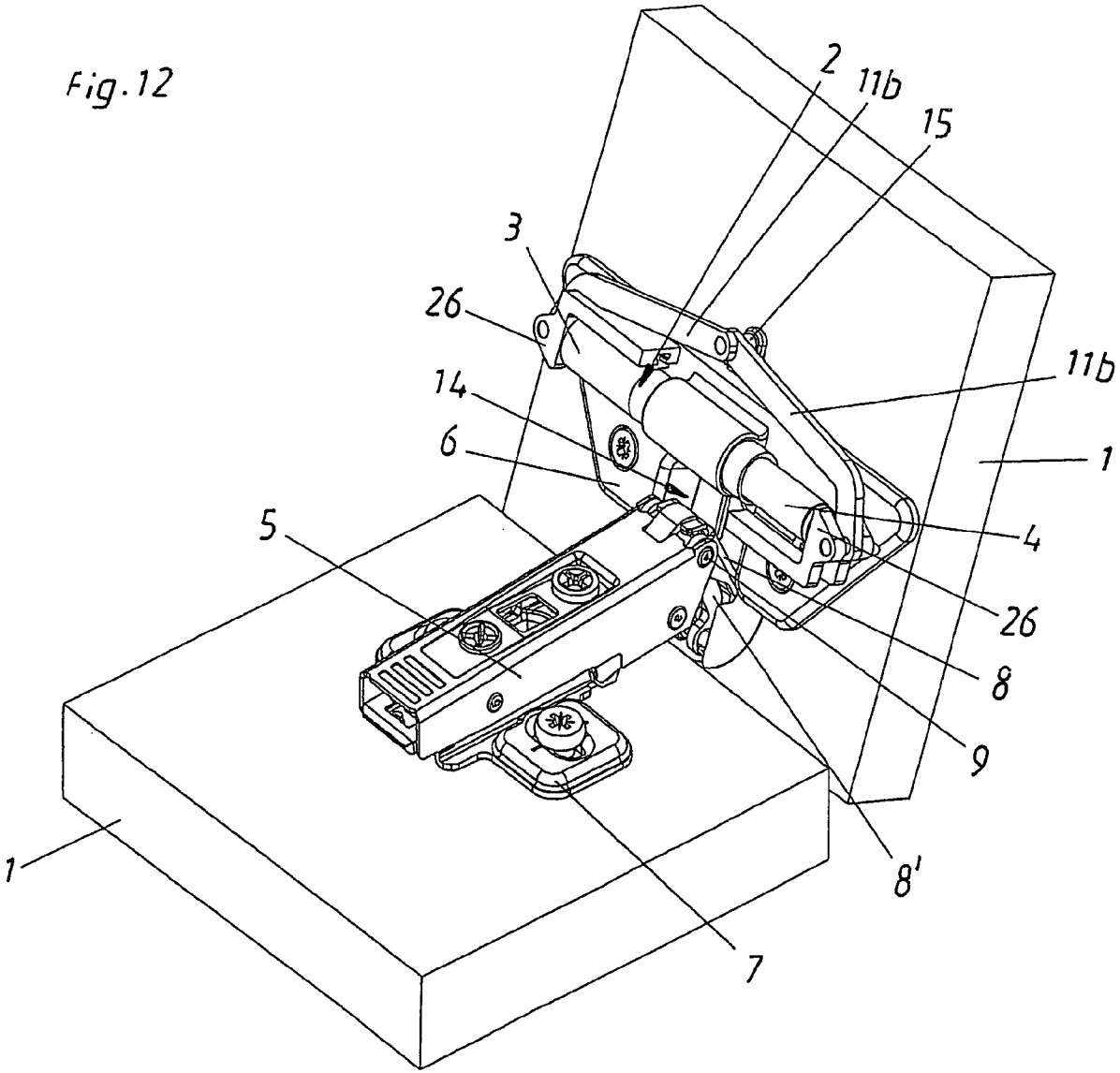
Figure 13:
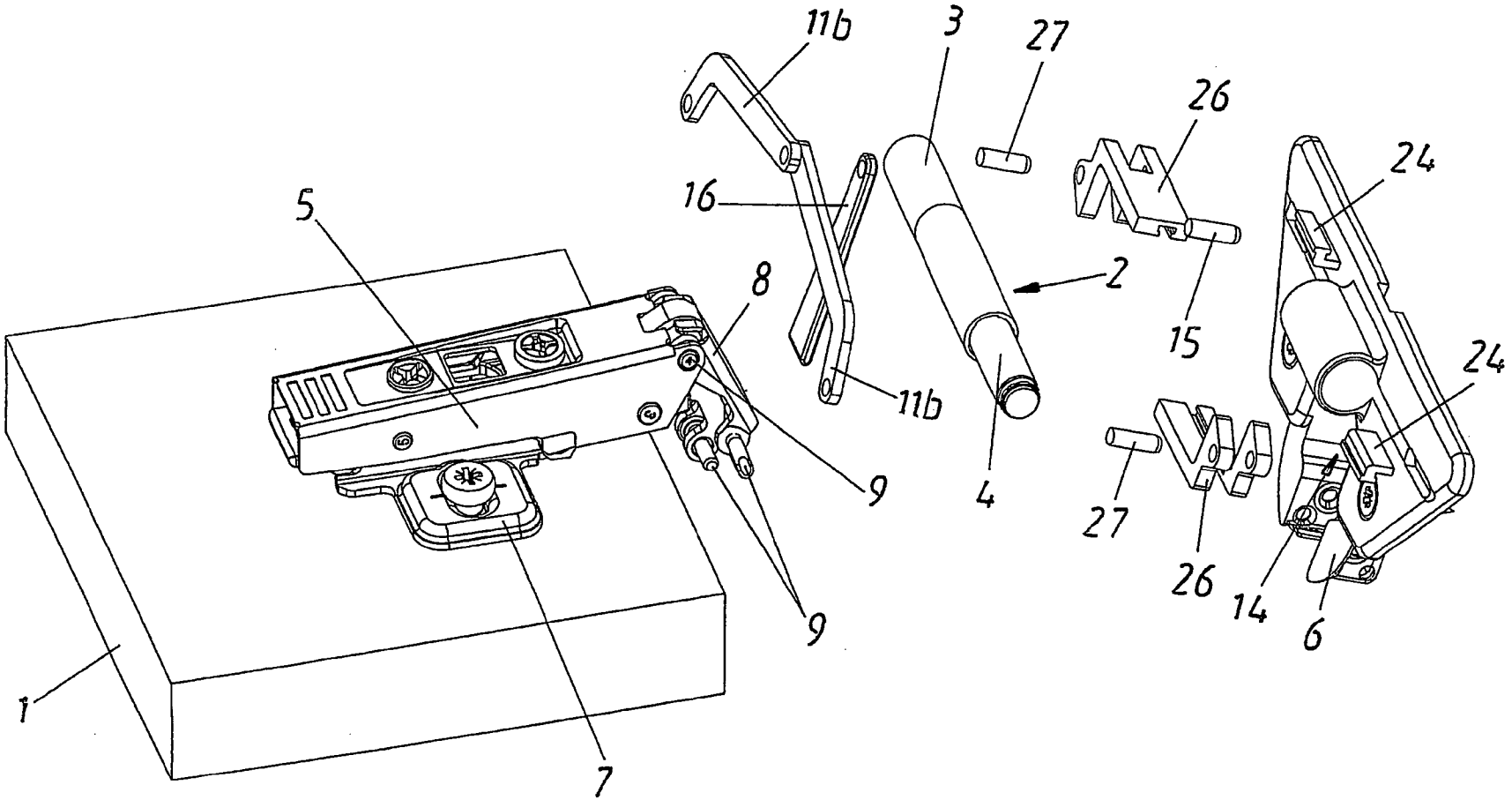
Figure 14:
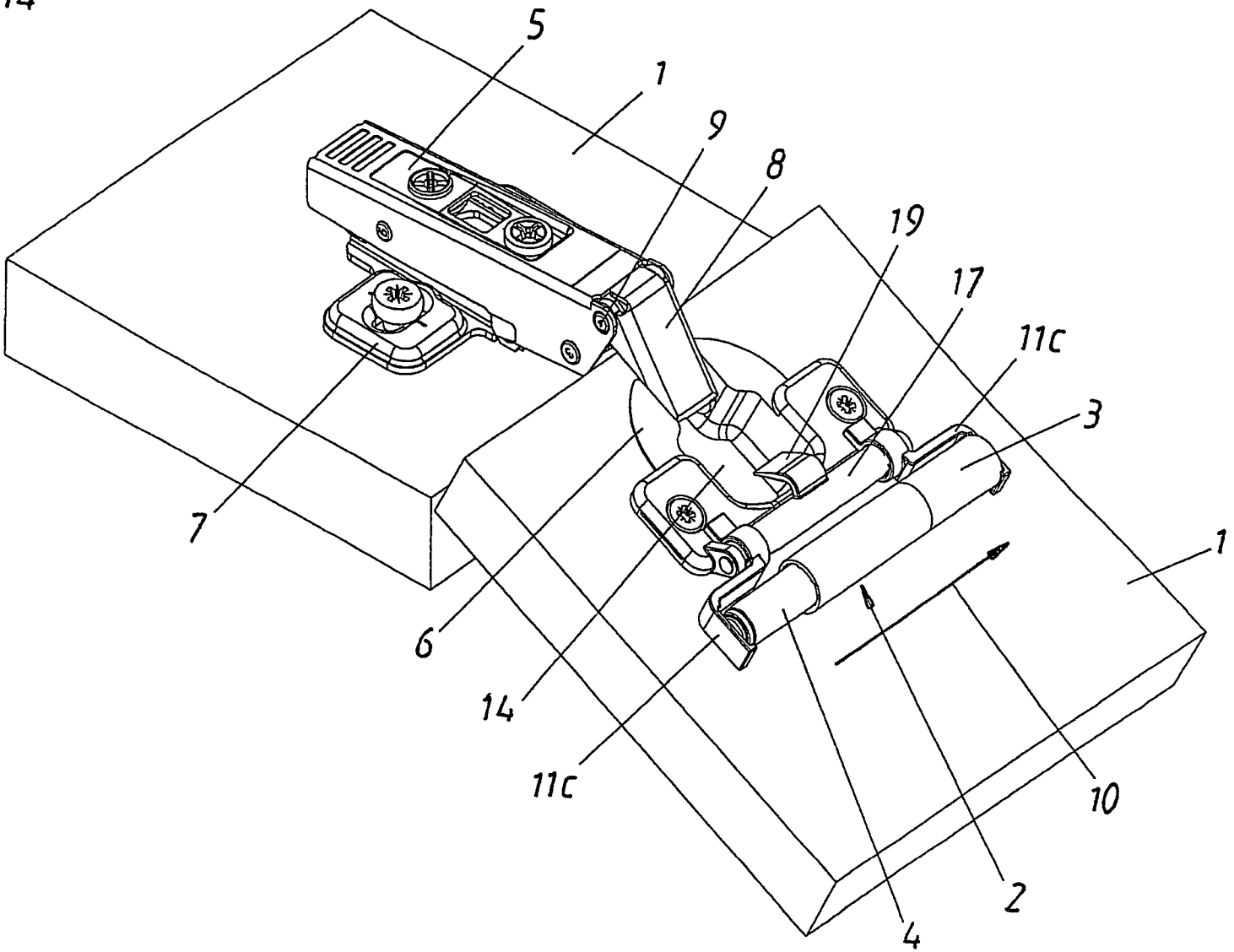
FIGS. 14 through 17 show a fourth embodiment by way of example of the invention.
Figure 15:
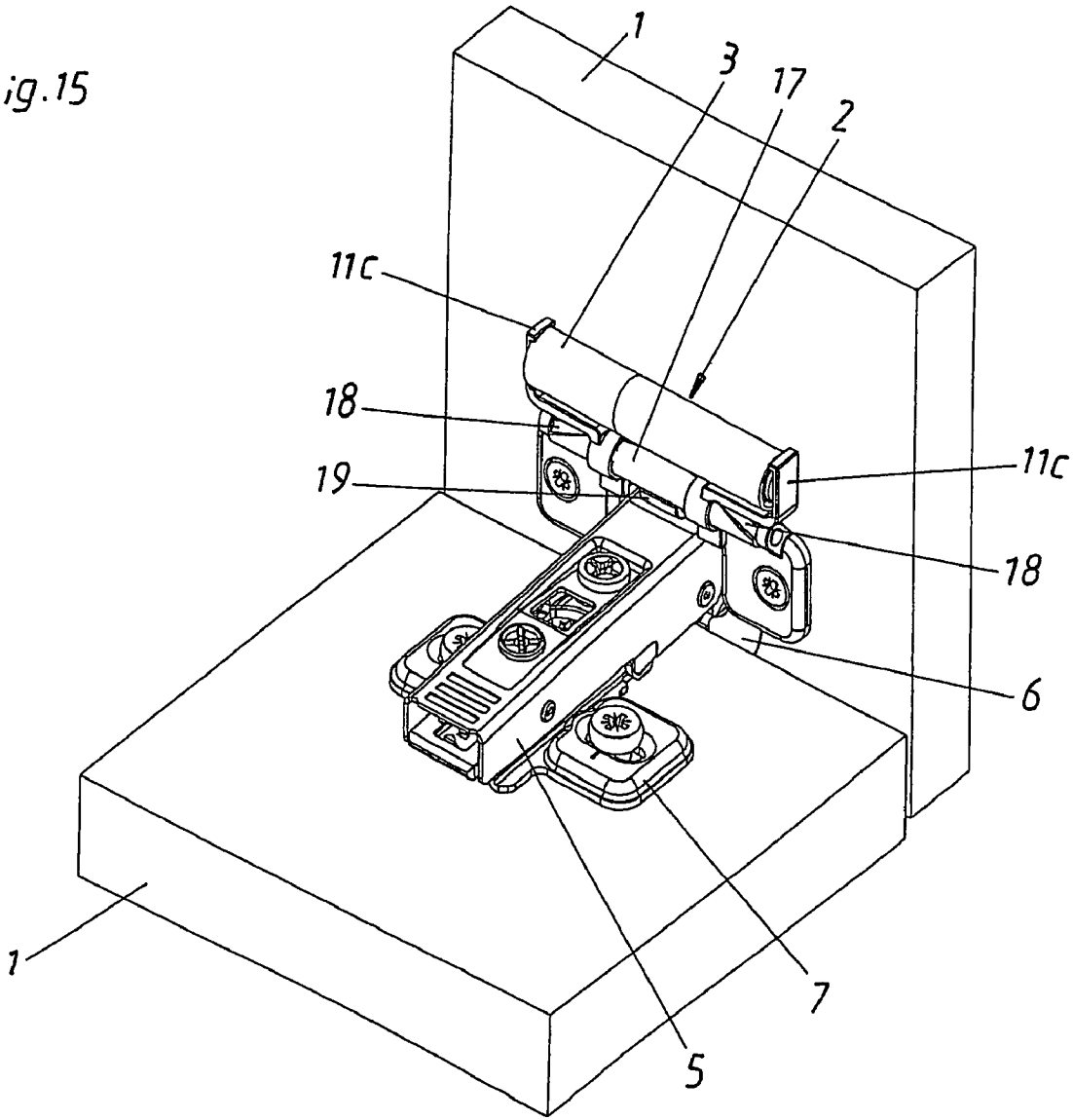

In the second embodiment according to the invention as shown in FIGS. 6 through 9 the tension cable 13 is an essential element of the transmission mechanism. The tension cable 13 is anchored at its one end to the cup 6 by way of a fixing point 23. The other end of the tension cable 13 is fixed to the transmission lever 11*a*. During pivotal movement of the parts 1 of the article of furniture out of the open position shown in FIG. 6 into the closure position shown in FIG. 7, the outer hinge lever 8, from a certain closure angle as measured between the two parts 1 of the article of furniture, acts upon the tension cable 13. As a result, as the closure movement continues, the tension cable 13 is pressed progressively further into the recess 14 of the hinge cup 6. As a result, the transmission lever 11*a* is in turn charged and moved in the direction 10 (by being pulled by the end of tension cable 13), whereby the pusher 4 is pressed into the housing 3 in the damping stroke. In this embodiment, the housing 3 is held to the hinge cup 6 in a support sleeve 25 fixedly, that is to say non-displaceably. The transmission lever 11*a* is guided on the guide rail 24 both in the damping stroke and also in the opposite stroke. Suitably bendable steel or plastic cables or other materials are used as the tension cable 13. It is important in that respect that the tension cable 13 has on the one hand adequate deformability so that it can be pressed into the recess 14 of the hinge cup 6, while on the other hand however a substantial change in length of the tension cable 13 should not take place in order to ensure an appropriate damping stroke. FIG. 8 and the region shown on an enlarged scale thereof in FIG. 8*a* show the closure angle between the parts of the article 1, at which the hinge lever 8 begins to actuate the transmission mechanism and therewith the tension cable 13, whereby the damping stroke of the damper 2 is initiated. FIG. 9 in turn shows the individual parts of this embodiment as an exploded view.

The embodiment of the invention according to FIGS. 10 through 13 shows a variant of a transmission mechanism, in which the transmission levers 11*b* engage the damper 2 in a tongs-like configuration by way of the guided supports 26. The connection between the support 26 which is guided in the guide rails 24 and the transmission levers 11*b* is of a pivotable nature by means of the axes (pins) 27. At their respective other ends, the transmission levers 11*b* are operatively connected together and to a thrust lever 16 by way of a hinged connection 15. The damping stroke in the direction 10 is triggered as from a certain closure angle between the parts 1 of the article of furniture, at the moment at which the thrust lever 16 encounters the outer hinge lever 8. During further closure in the direction of the closure position shown in FIG. 11, the hinge lever 8 pushes the thrust lever 16 in the direction 35 whereby the transmission levers 11*b* pushes the pusher 4 in the direction 10 into the housing 3 whereby the damping stroke is produced. The individual components can in this case also be particularly clearly seen from the exploded view of FIG. 13.

Figures 16, 16A:
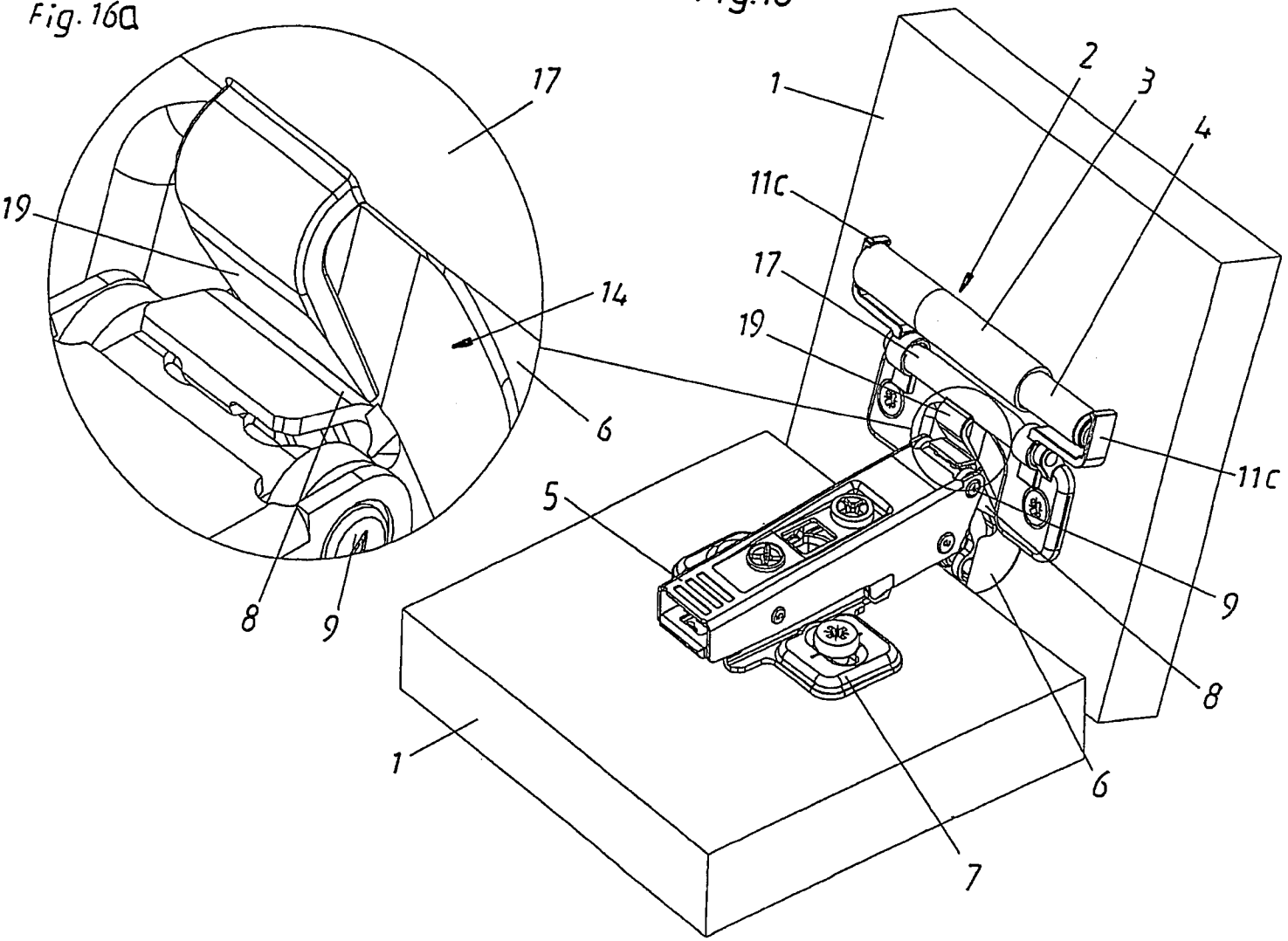
Figure 17:
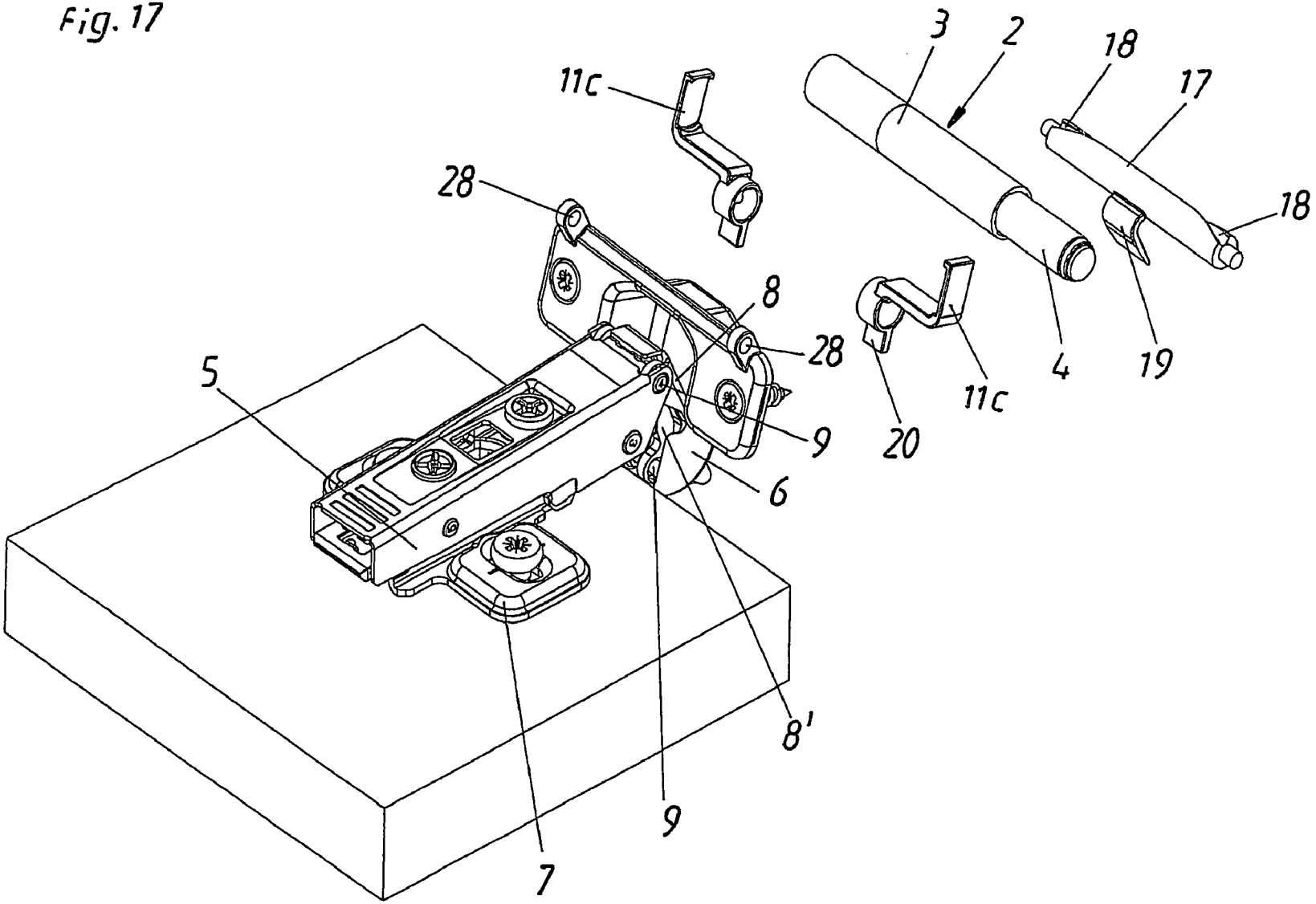
Figure 18:
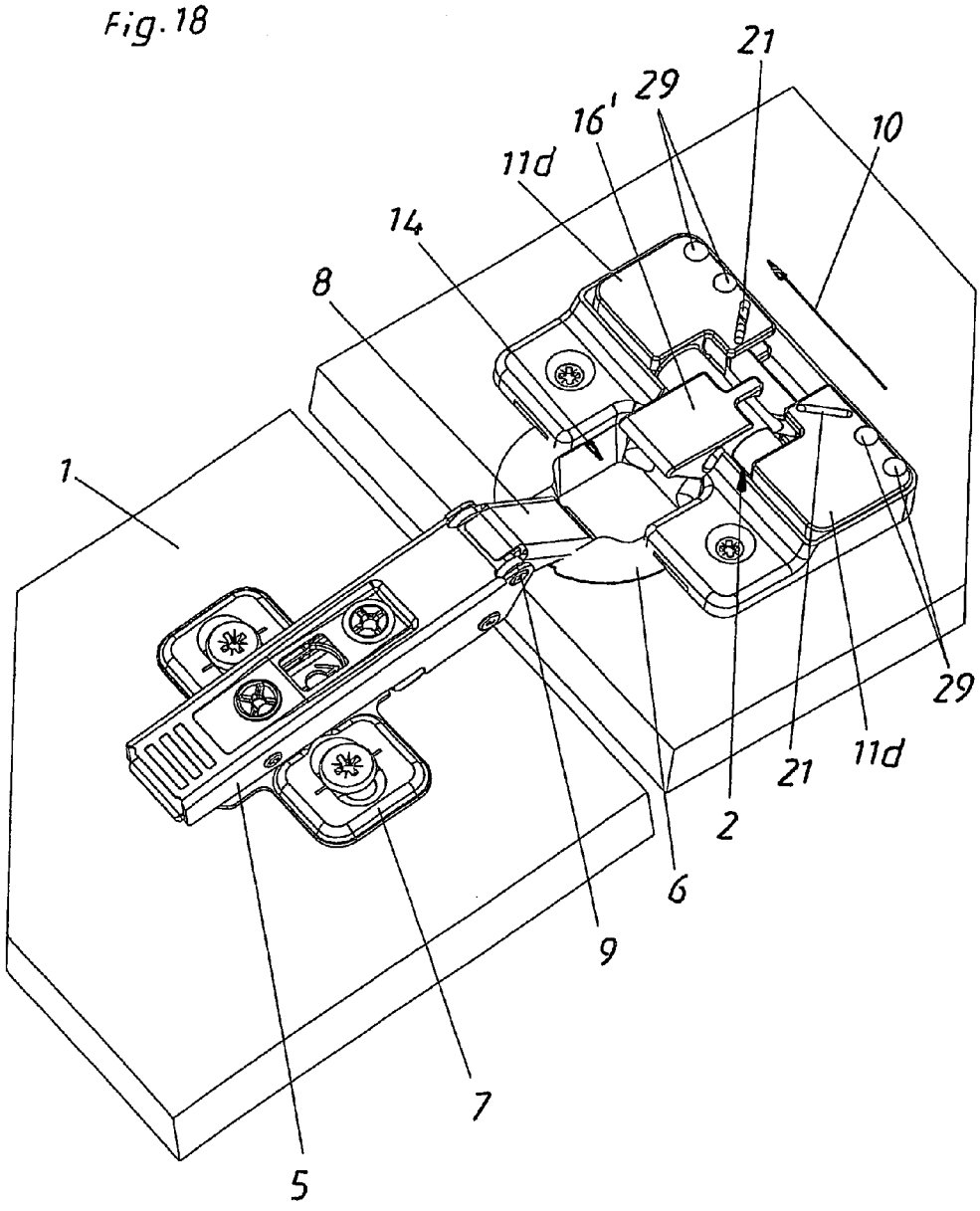
FIGS. 18 through 22 show a fifth embodiment by way of example of the invention.

In the embodiment shown in FIGS. 14 through 17, the rotational body 17 which is rotatably supported in the mounting means 28 forms an essential part of the transmission mechanism. At its surface, it has screw-like or worm-like guide paths 18 into which the transmission levers 11*c* engage by means of the lugs 20. Rotation of the rotational body 17 begins as soon as the actuating lever 19 which is fastened to the rotational body 17 encounters the outer hinge lever 8 in the course of the pivotal movement of the parts 1 of the article of furniture in the direction of the closure position shown in FIG. 15. That angular position is shown in FIG. 16 and the detail thereof shown in FIG. 16*a*. In the further pivotal movement in the direction of the closure position shown in FIG. 15, the hinge lever 8 presses the actuating lever 19 in the direction of the recess 14 arranged on the hinge cup 6. That causes rotation of the rotational body 17 whereby the transmission levers 11*c* guided in the screw-like or worm-like guide paths 18 are moved towards each other in the direction (i.e., along the line or axis) 10 of the damping stroke. The result of that is again that the pusher 4 is pressed into the housing 3 of the damper in the course of the damping stroke. The return movement in the direction of the open position shown in FIG. 14 is again effected by the return spring which is here provided in the interior of the damper 2 and which is known in the state of the art.

Figure 19:
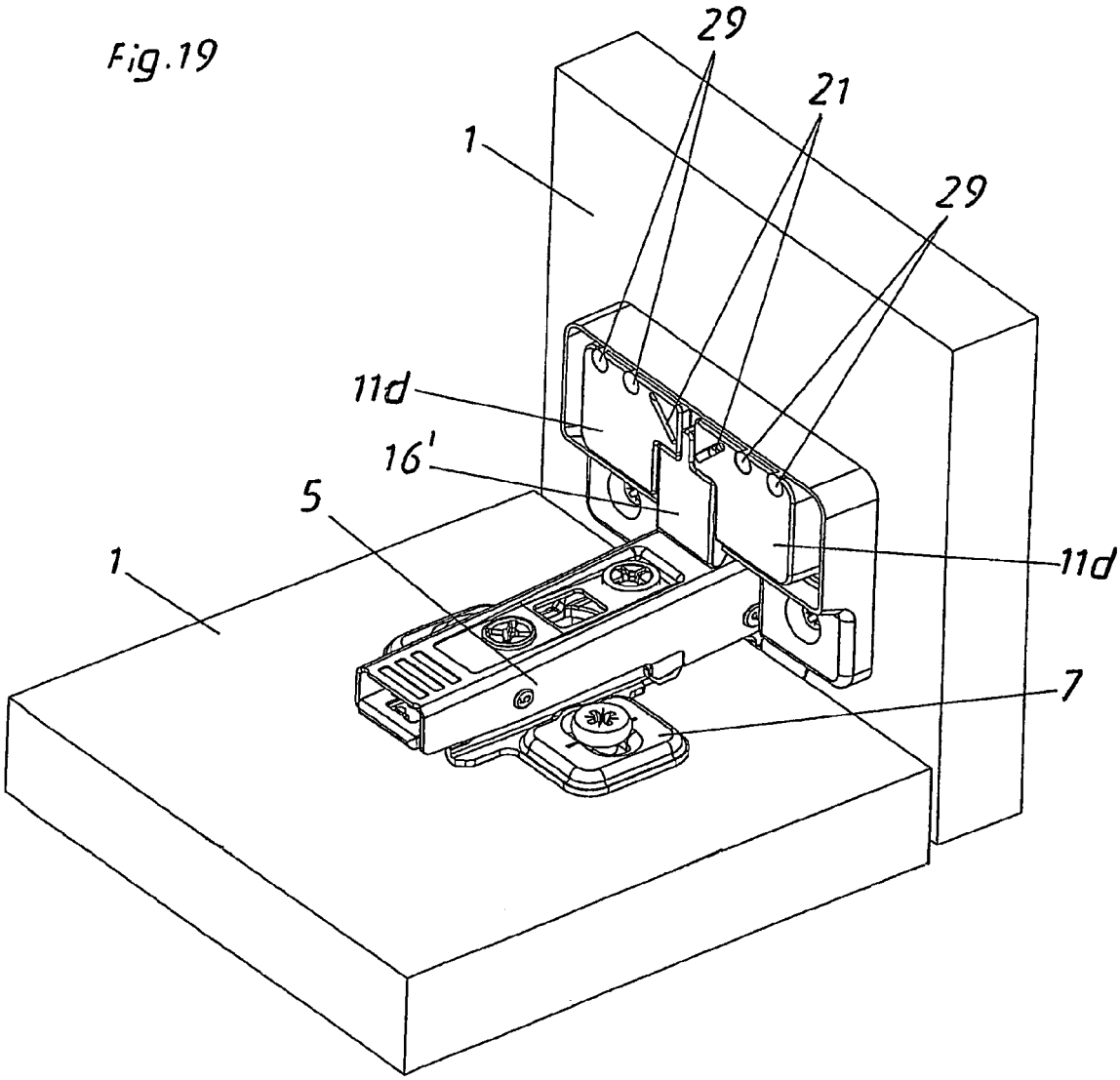
Figure 20A:
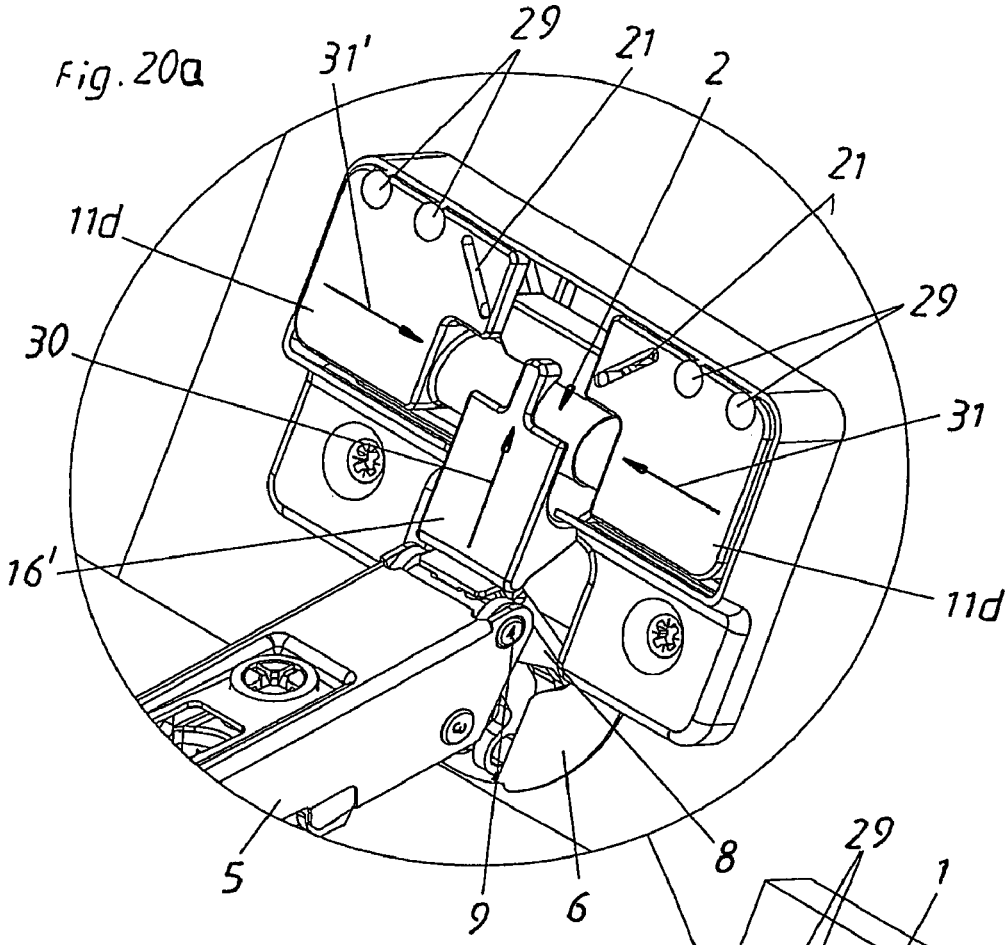
Figure 20:
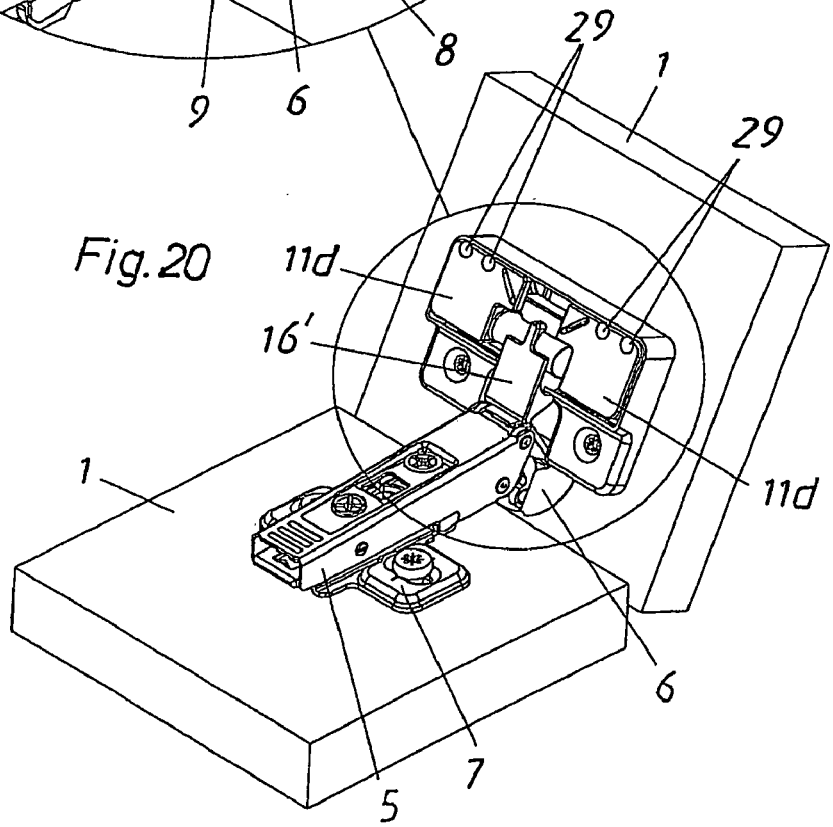
Figure 21:
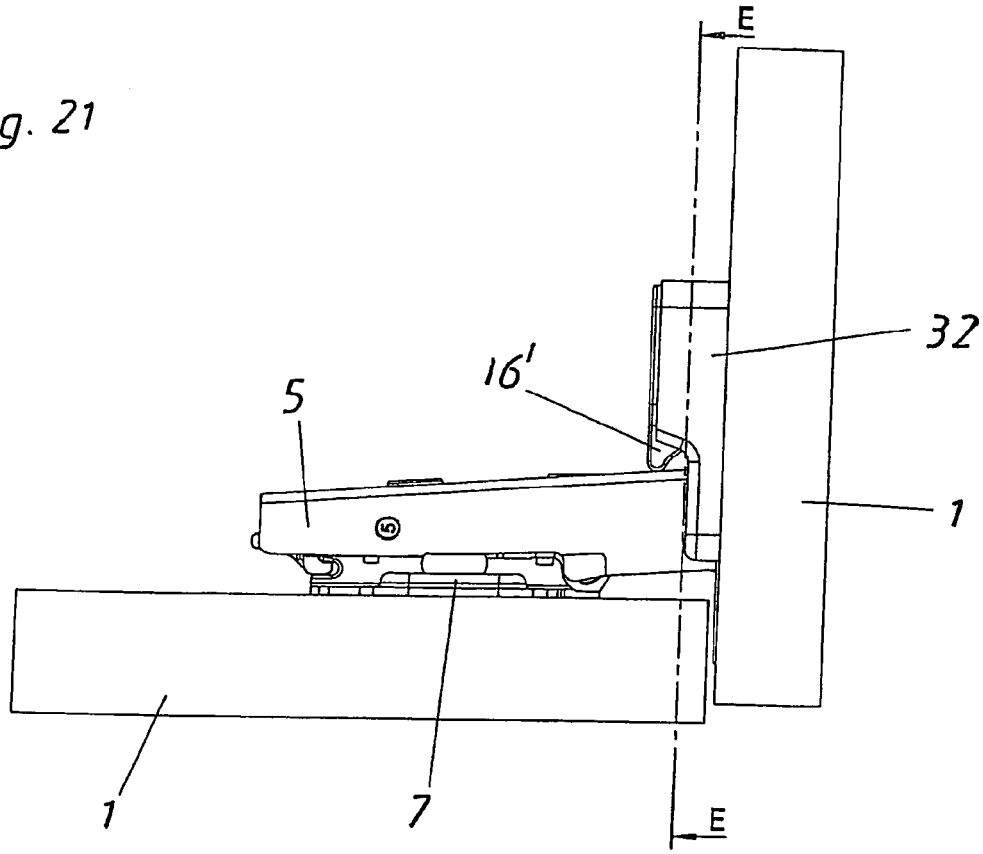
Figure 22:
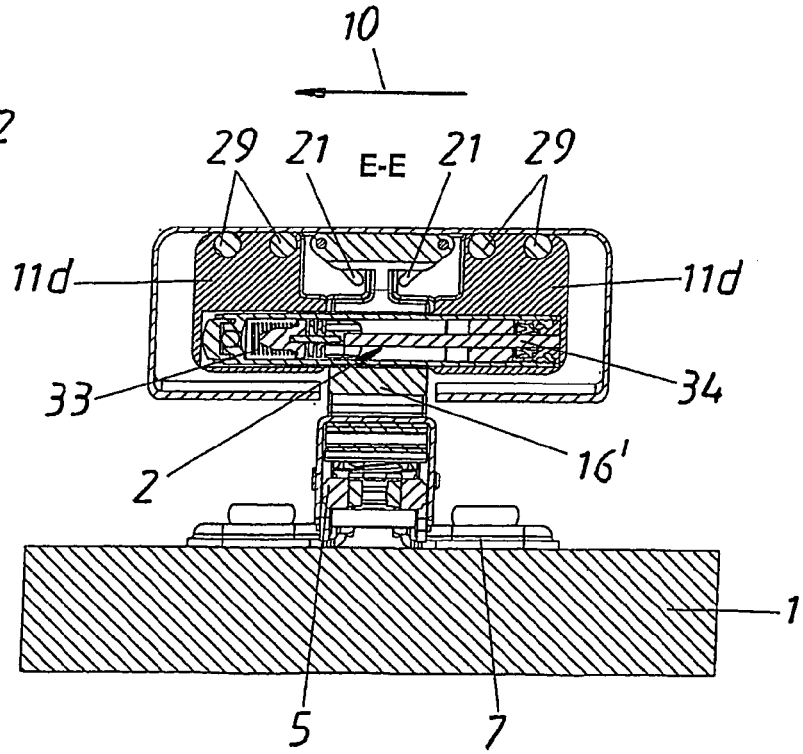
Figure 23:
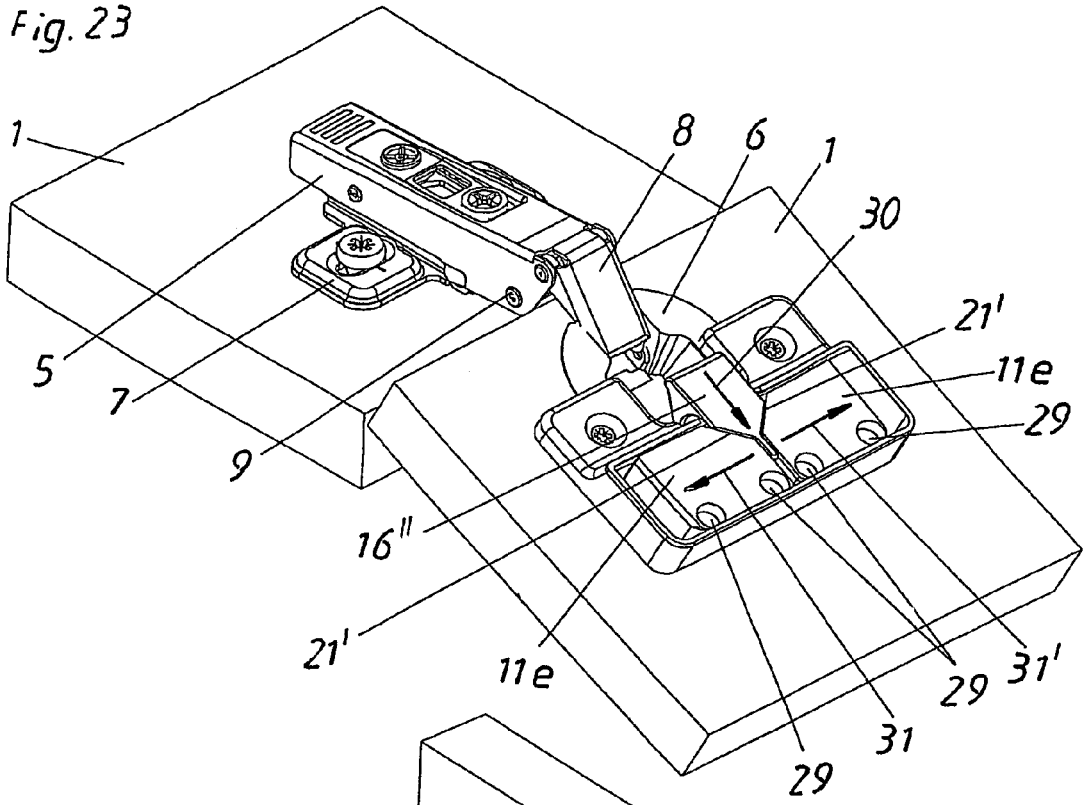
FIGS. 23 through 28 show a sixth embodiment by way of example of the invention.

The fifth embodiment shown in FIGS. 18 through 22 also provides that a thrust lever 16' is acted upon by the outer hinge lever 8 as from a certain closure position. It is thereby displaced in the direction (along the axis) 30. The thrust lever 16' is operatively connected to the two transmission levers 11*d* by way of inclined guide paths 21. Displacement of the thrust lever 16' in the direction 30 provides that the transmission levers 11*d* which are supported on the housing by way of rollers 29 or balls are moved towards each other in directions 31 and 31' whereby the damping stroke is again triggered, that is to say the pusher 4 is pushed into the housing 3. To provide for optimum force transmission, the linear or inclined guide paths 21 are arranged substantially at a 45° angle relative to the direction of movement 30 of the thrust lever 16'. FIG. 18 again shows the open position, while FIG. 19 shows the closure position with the transmission levers 11*d* displaced towards each other. FIG. 20 shows the beginning of the damping stroke. FIG. 20*a* shows the portion of FIG. 20, which is surrounded by the circle. FIG. 21 shows a side view and the section line EE. The associated section is shown in FIG. 22. There the return spring 33 of the per se known damper 2 is shown, which in the pivotal movement into the open position shown in FIG. 18, urges the transmission levers 11*d* away from each other again in opposite relationship to the direction 10 of the damping stroke. It is also to be noted that the pusher (piston rod) 34, along the longitudinal extent of which the damping stroke takes place, is naturally also arranged parallel or in other embodiments at a suitable angle in relation to the hinge axis 9.

Figure 24:
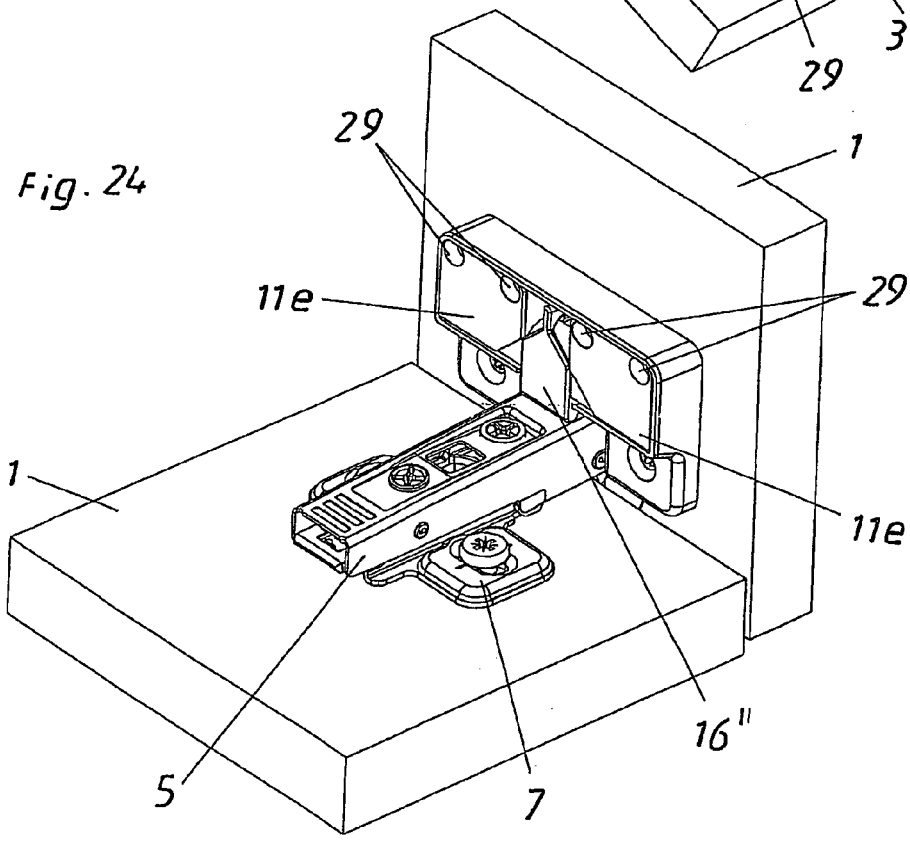
Figure 25A:
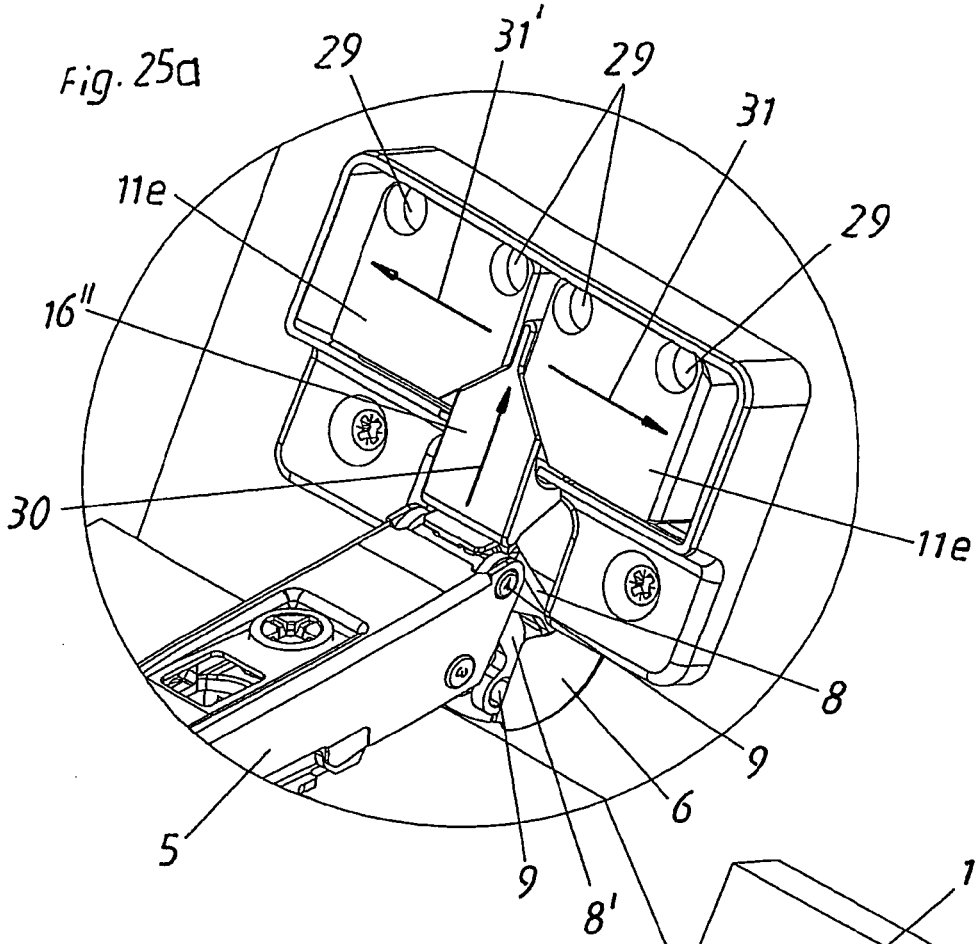
Figure 25:
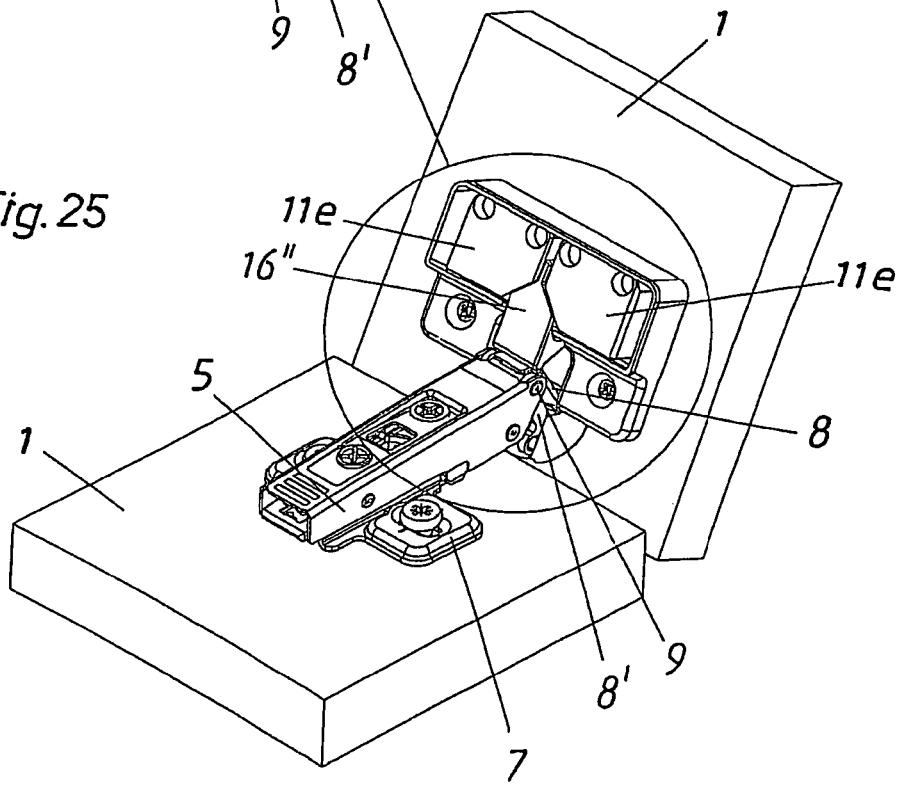
Figure 26:
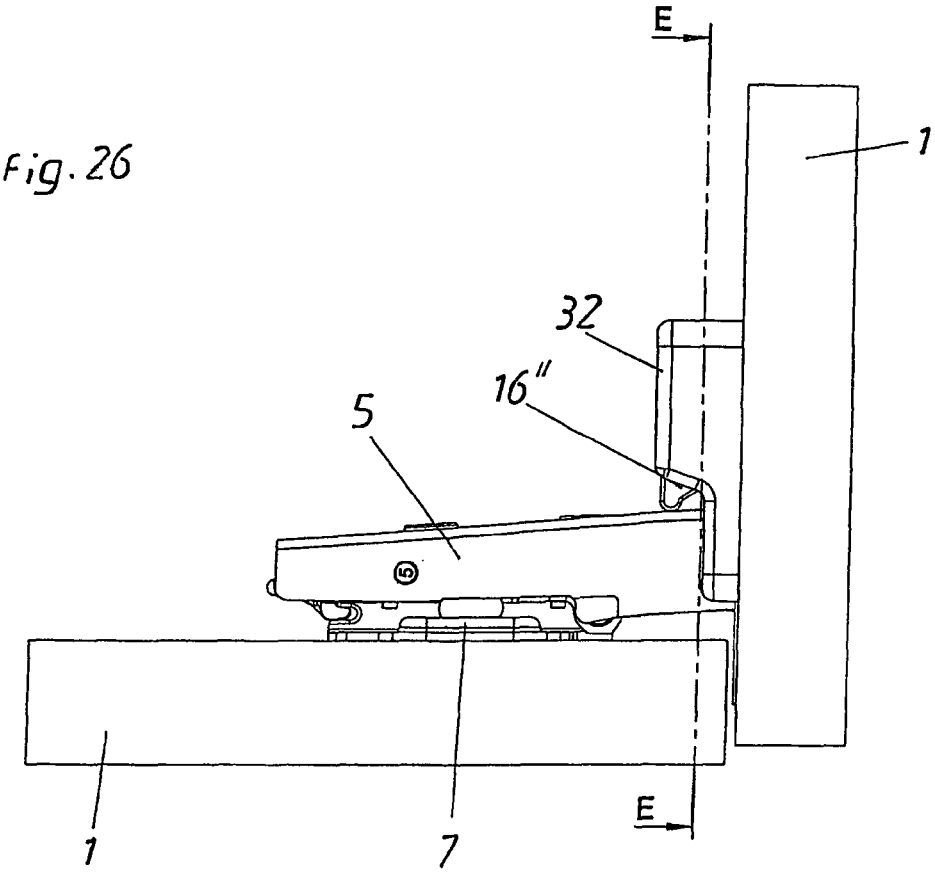
Figure 27:
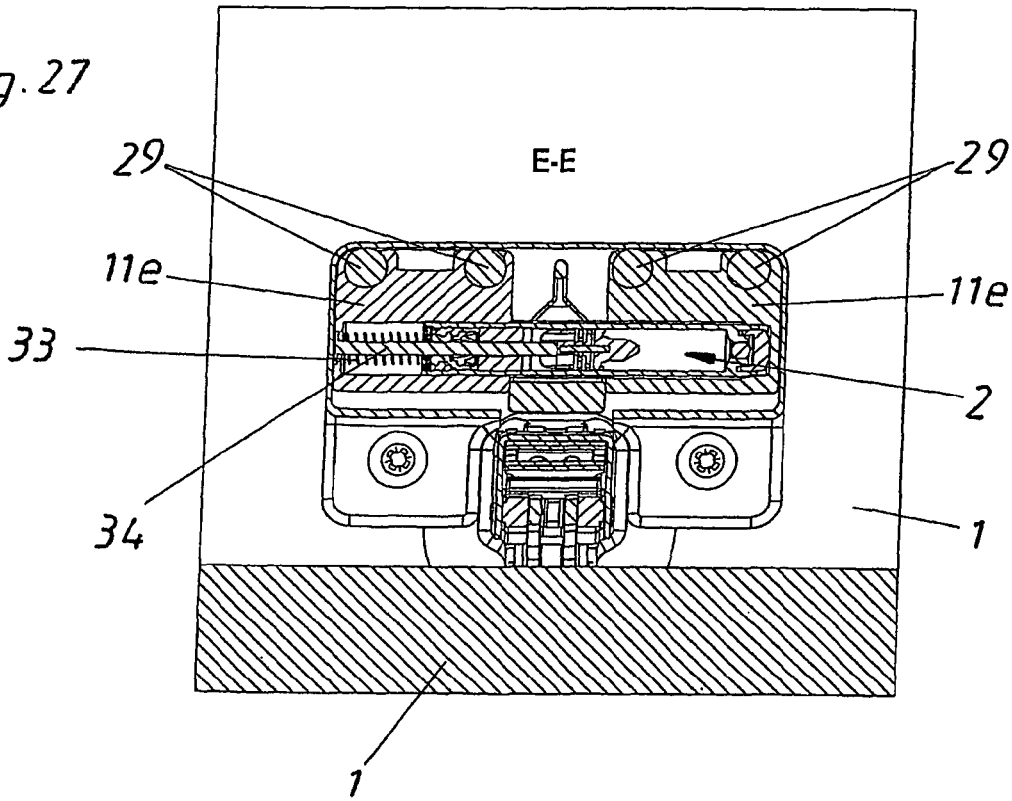
Figure 28A:
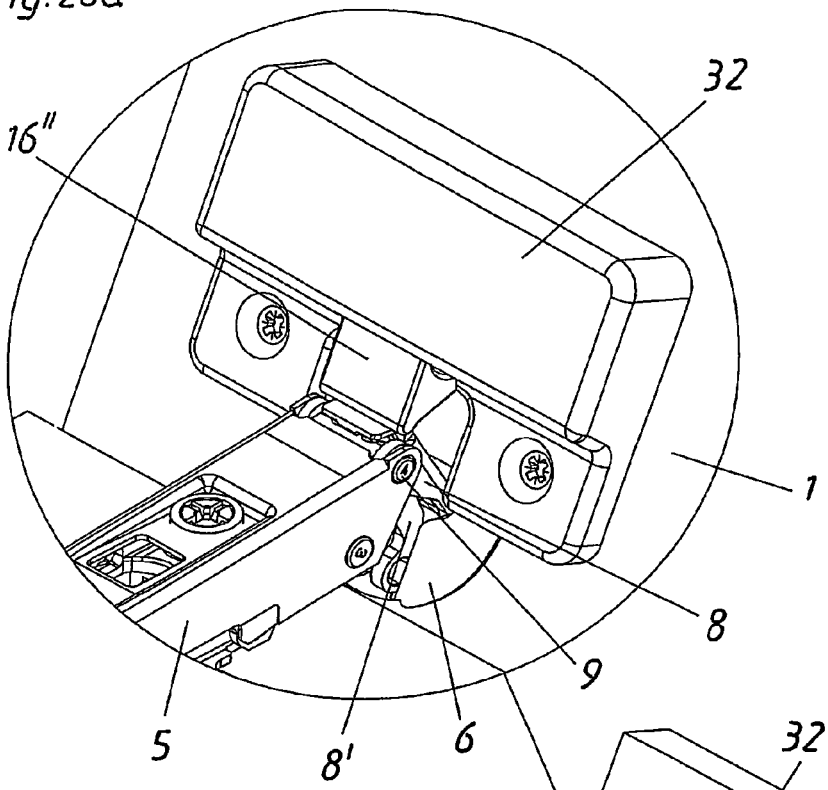
Figure 28:
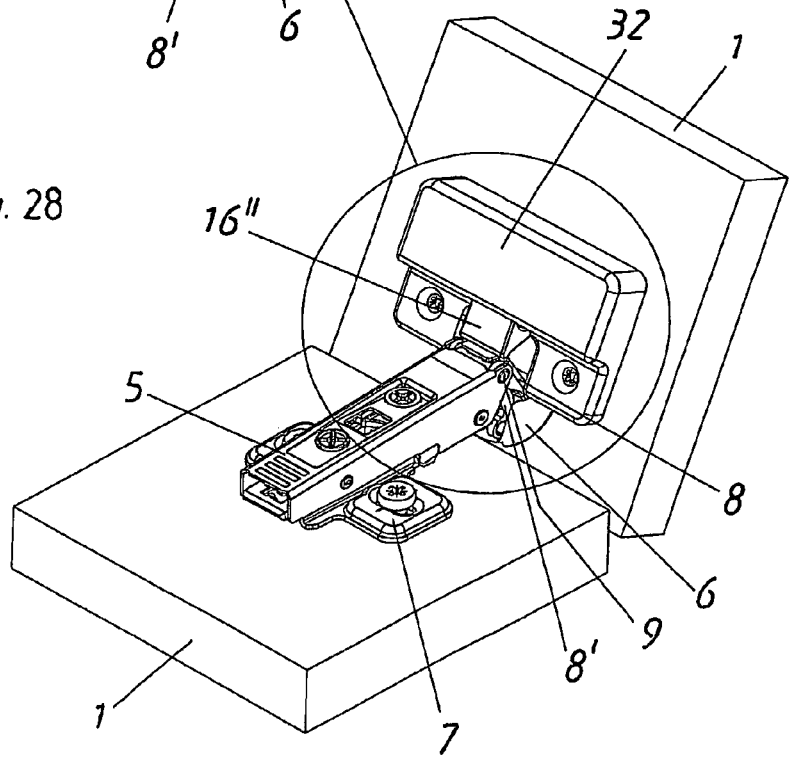

In regard to the next embodiment of FIGS. 23-28, FIG. 23 again shows the open position and FIG. 24 the closure position. As from the closure angle of the parts 1 of the article of furniture, as shown in FIG. 25 and in detail in FIG. 25*a*, when the closure movement is continued, in the direction of the situation shown in FIG. 24, the thrust lever 16" is displaced in the direction (along axis) 30. In that situation, it presses the two transmission levers 11*e* away from each other in the direction of the arrows 31 and 31' whereby the damping stroke is triggered. The damping stroke therefore takes place in this variant by the damper components 3 and 4 being pulled away from each other, in contrast to the above-discussed embodiments. For that purpose, in FIG. 27, the pusher (piston rod) 34 which is shown in the section view according to FIG. 26 is fixed to one of the transmission levers 11*e* in such a way as to resist a traction force thereon, while the housing 3 or the cylinder of the damper 2 is fixed to the other transmission lever 11*e* in such a way as to resist a traction force thereon. This embodiment also provides that the transmission levers 11*e* are supported on the cover housing 32 by way of guide rollers 29 or balls. The guide surfaces 21' are once again beneficially arranged at a 45° angle relative to the direction of movement 30 of the thrust lever 16". While the cover means was not shown in the above-discussed Figures relating to the fifth and sixth embodiments, in order to be able to show the interior of the respective transmission mechanism, FIG. 28 shows an outside view of the cover housing 32, as presents itself to the user after assembly has been effected.

Figure 29:
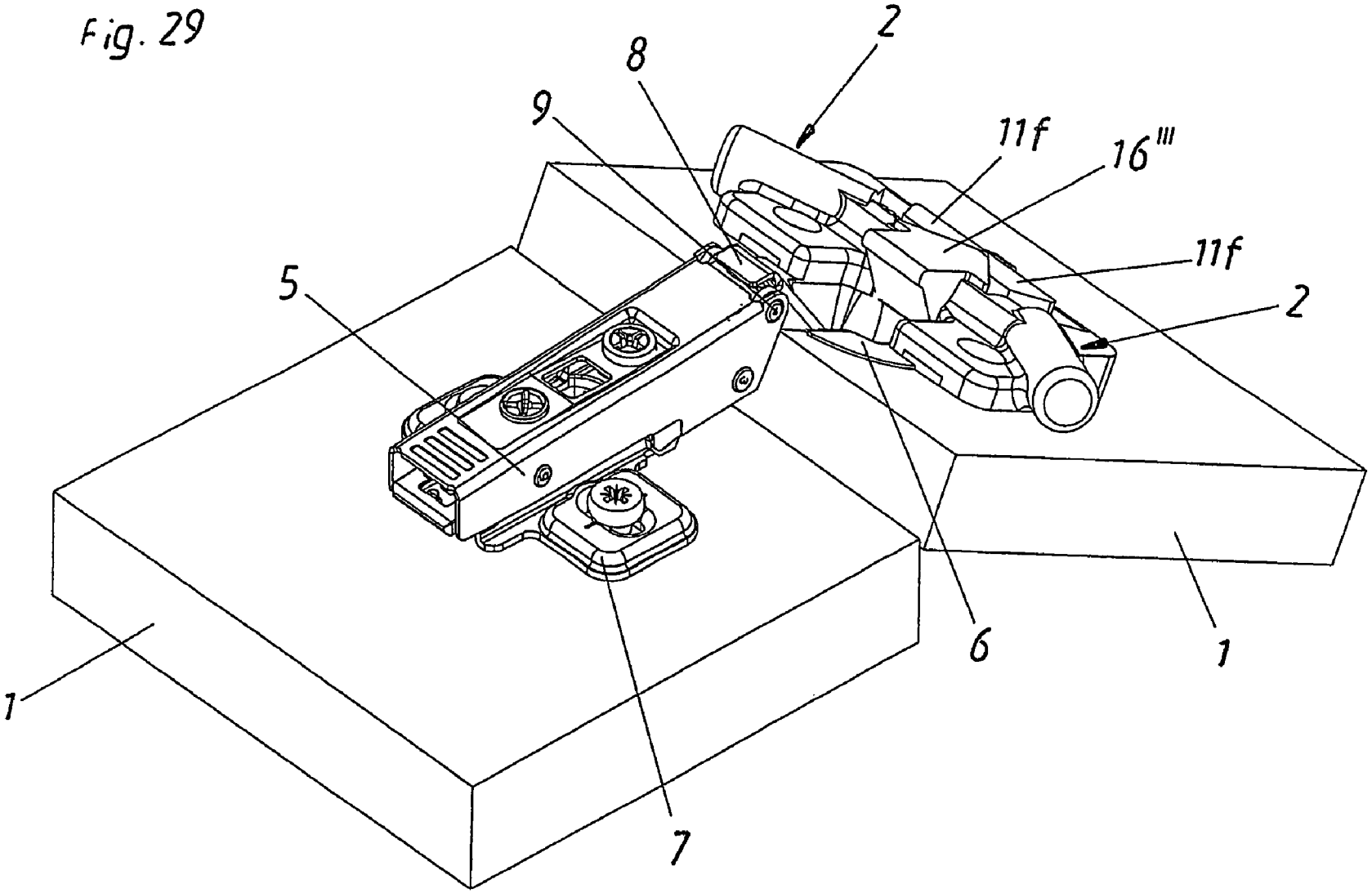
FIGS. 29 through 31 show a seventh embodiment by way of example of the invention.
Figure 30:
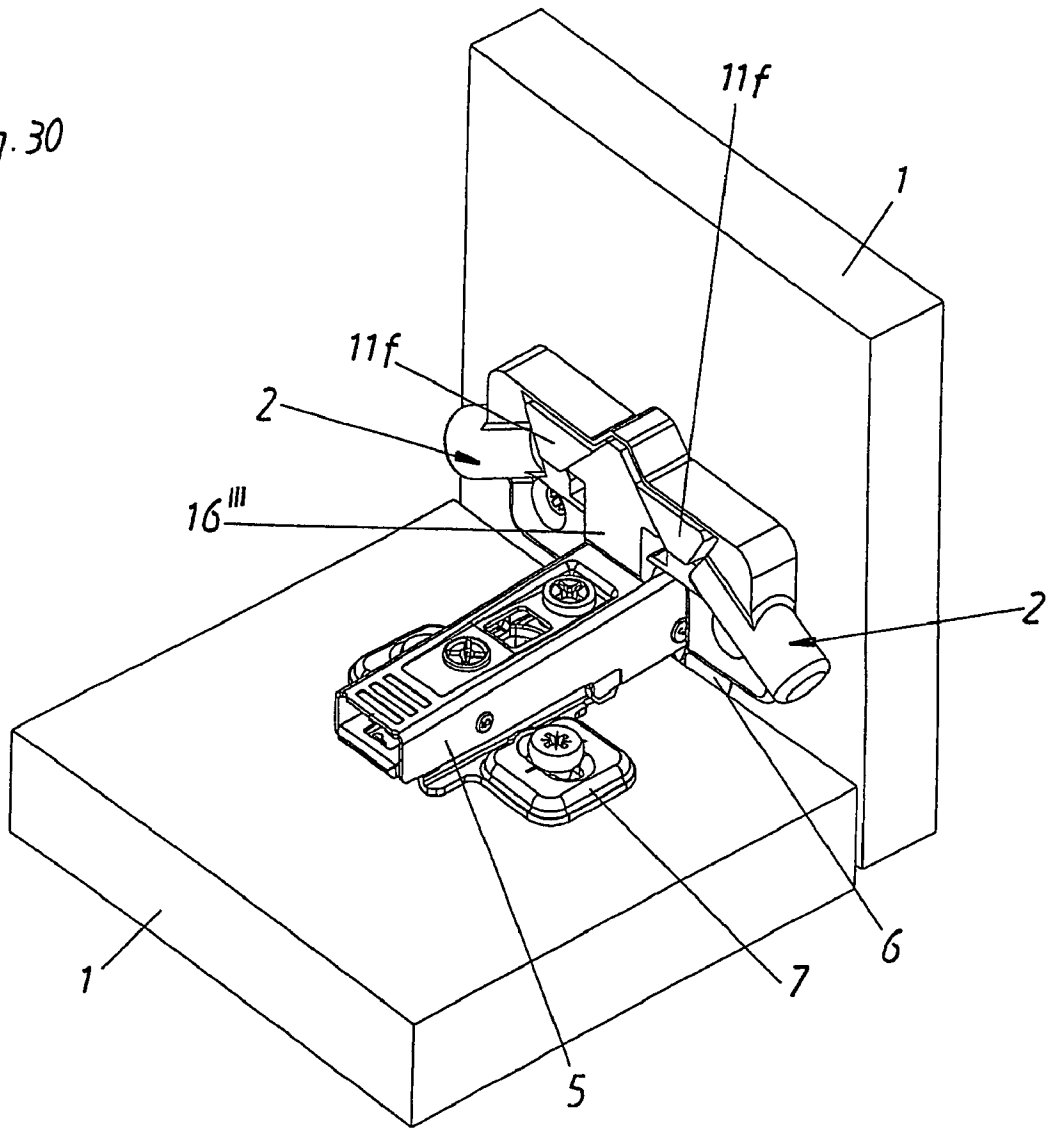
Figure 31:
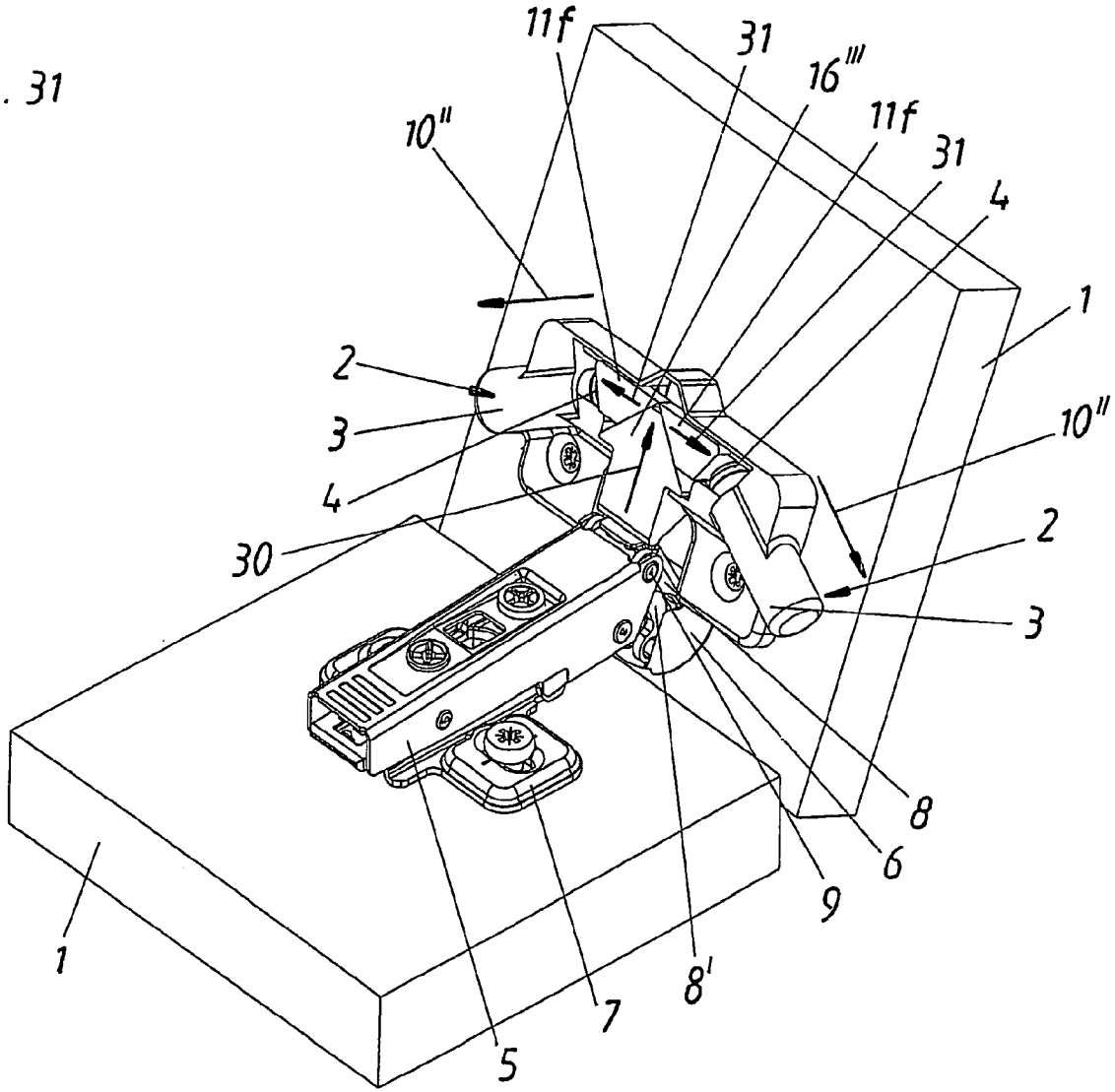

The seventh embodiment of FIGS. 29 through 31 shows a variant in which two dampers 2 are so arranged that the direction of their damping stroke (axis or line of damping movement) 10" respectively runs at 60° relative to a perpendicular 36 to a line 37 parallel to the hinge axis 9. FIG. 29 shows the open position and FIG. 30 the closure position. FIG. 31 shows the angular position between the two parts 1 of the article of furniture at which, when the closure movement continues, the damping stroke of the dampers 2 begins. The thrust lever 16'" is pushed by the outer hinge lever 8 as from that closure angle in the direction 30 by way of inclined guide surfaces 21' which once again are beneficially arranged at an angle of 45° relative to the direction of movement 30. That displacement of the thrust lever 16'" is leading to a displacement of the transmission levers 11*f* in the directions 31. As a result, the pushers 4 of the dampers 2 are pushed into the respective cylinders 3 whereby the damping strokes are triggered in the directions 10". Once again, the cover housing 32 is omitted from FIGS. 29 through 31 in order to be able better to show the transmission mechanism. After the damping stroke has occurred, the return movement from the closure position shown in FIG. 30 into the open position shown in FIG. 29 is effected by means of the return springs arranged in the damper (they are not to be explicitly seen here). In this arrangement, therefore, the damping stroke of the dampers is again completed when the pushers 4 are pushed into the respective cylinders 3 of the dampers 2. The transmission levers 11*f* are beneficially again supported on the housing displaceably by way of rails or by way of balls or rollers which are not explicitly illustrated here.

Figure 32:
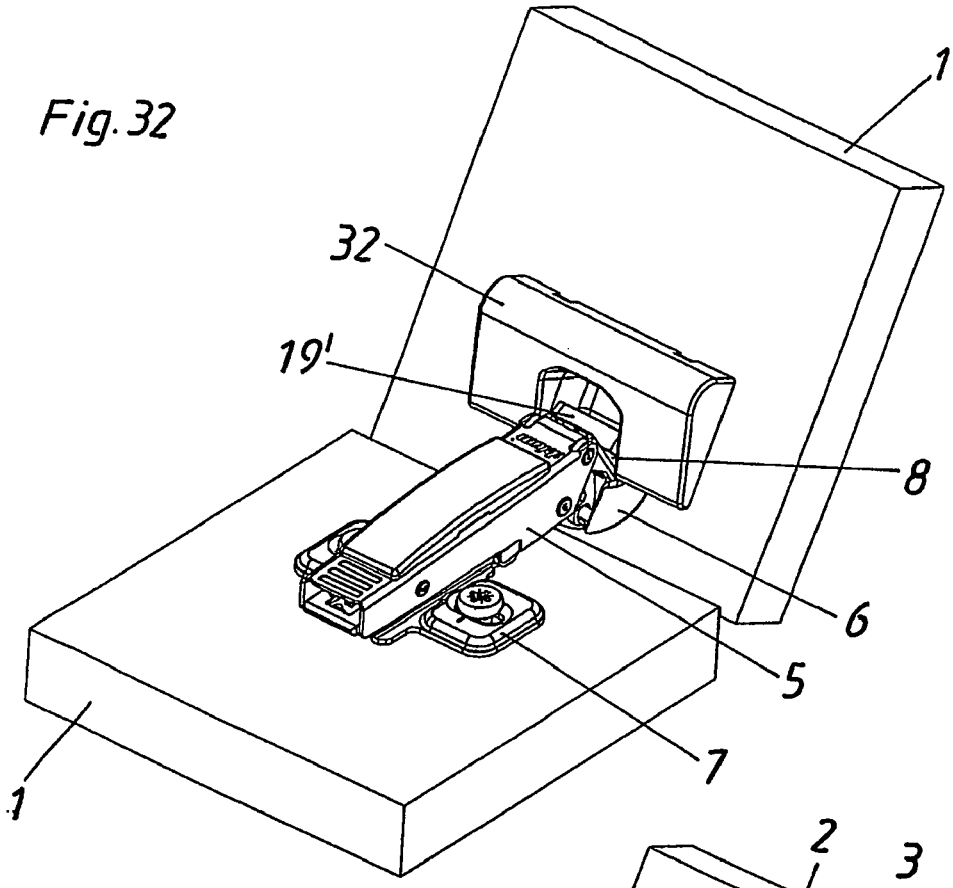
FIGS. 32 through 37 show an eighth embodiment by way of example of the invention.
Figure 33:
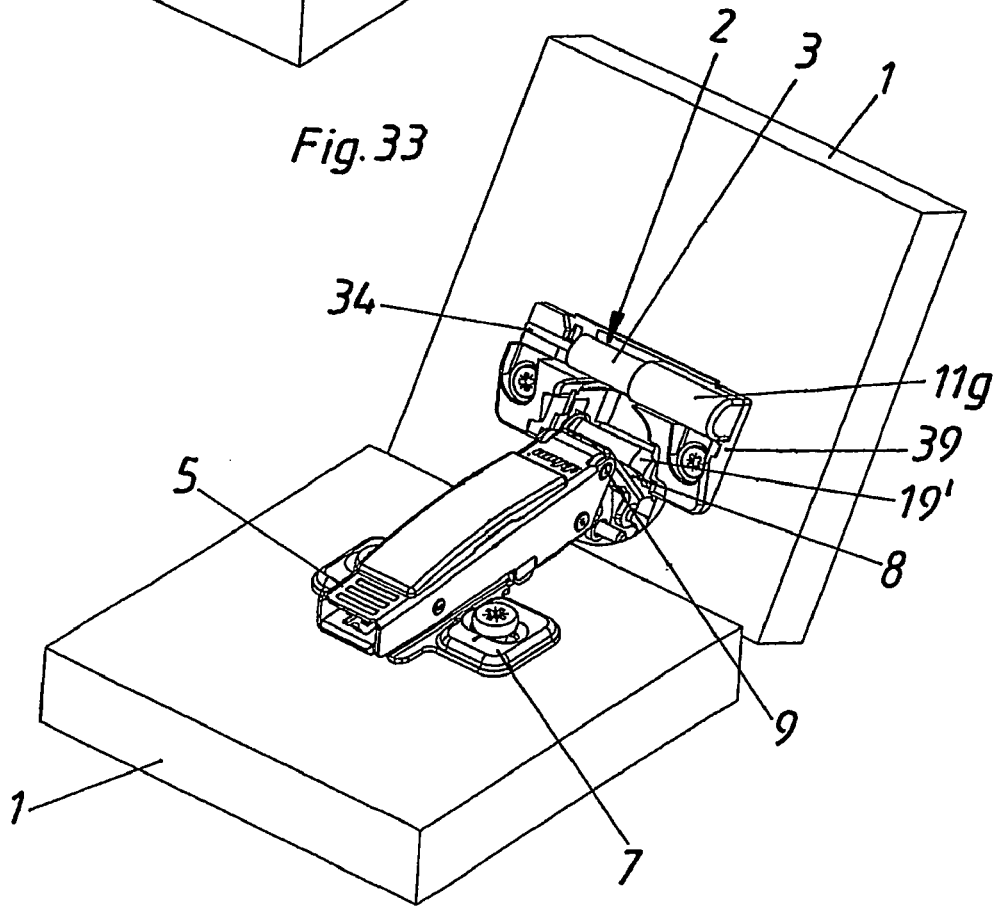
Figure 34:
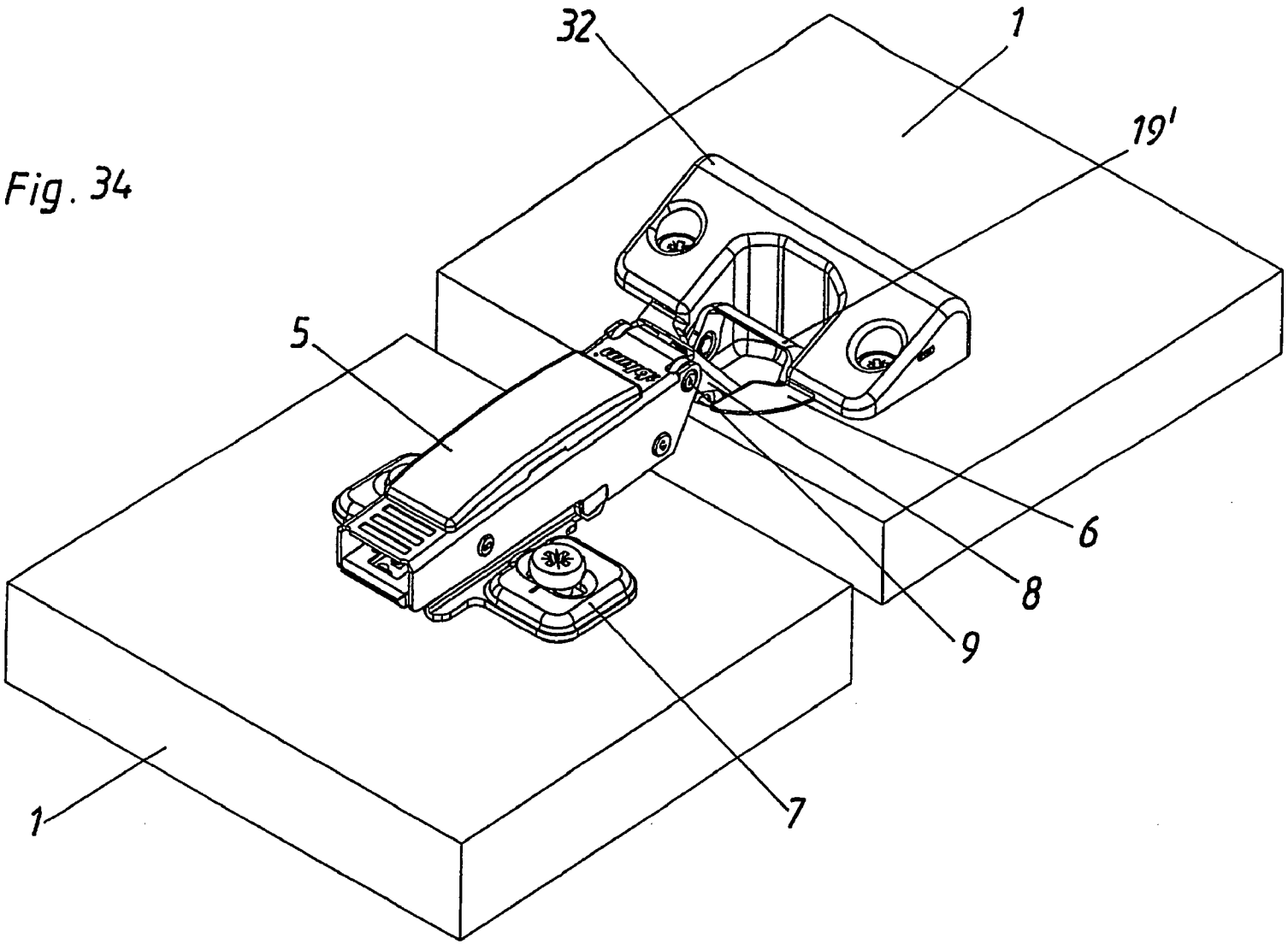
Figure 35:
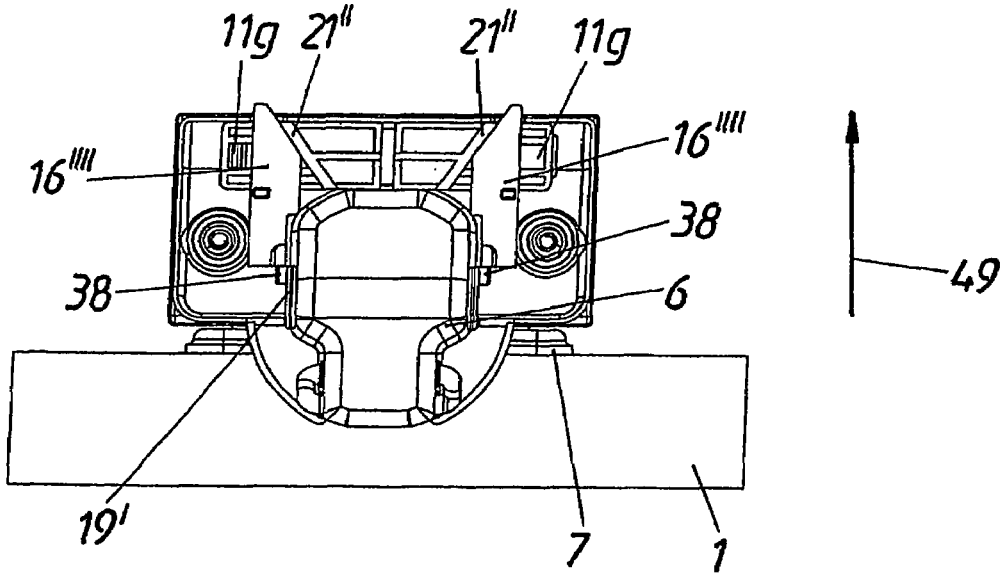
Figure 36:
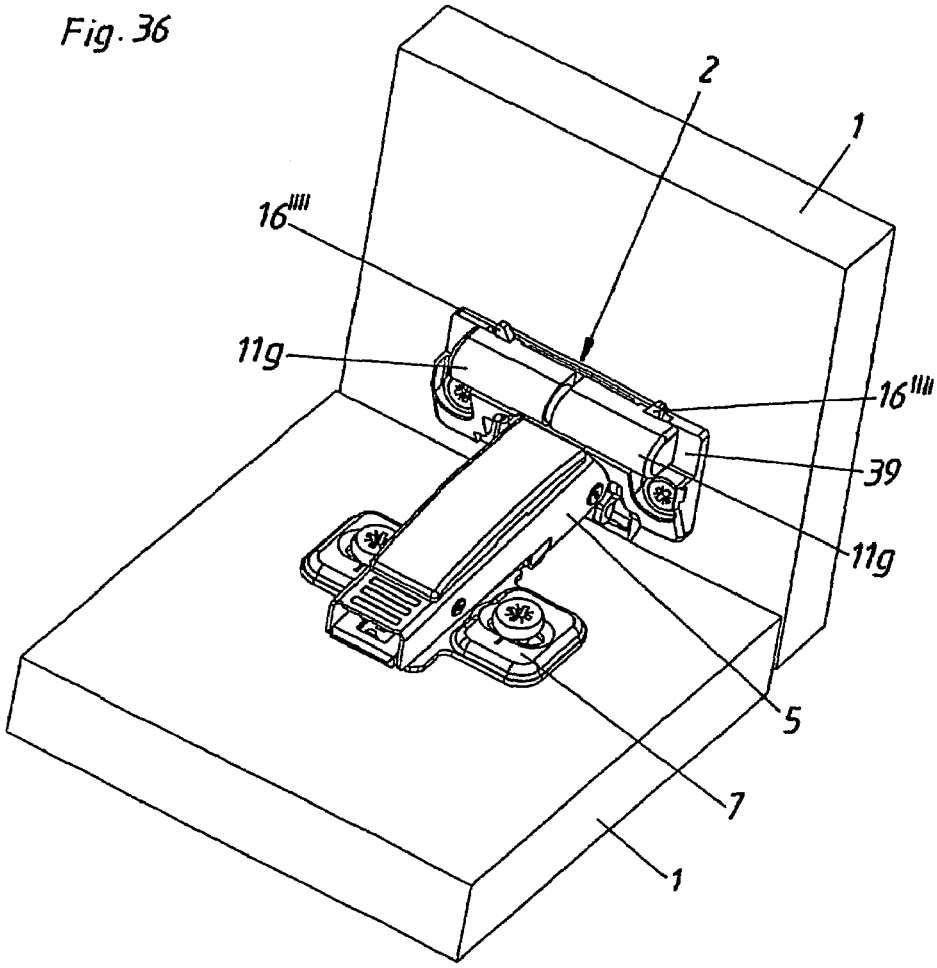
Figure 37:
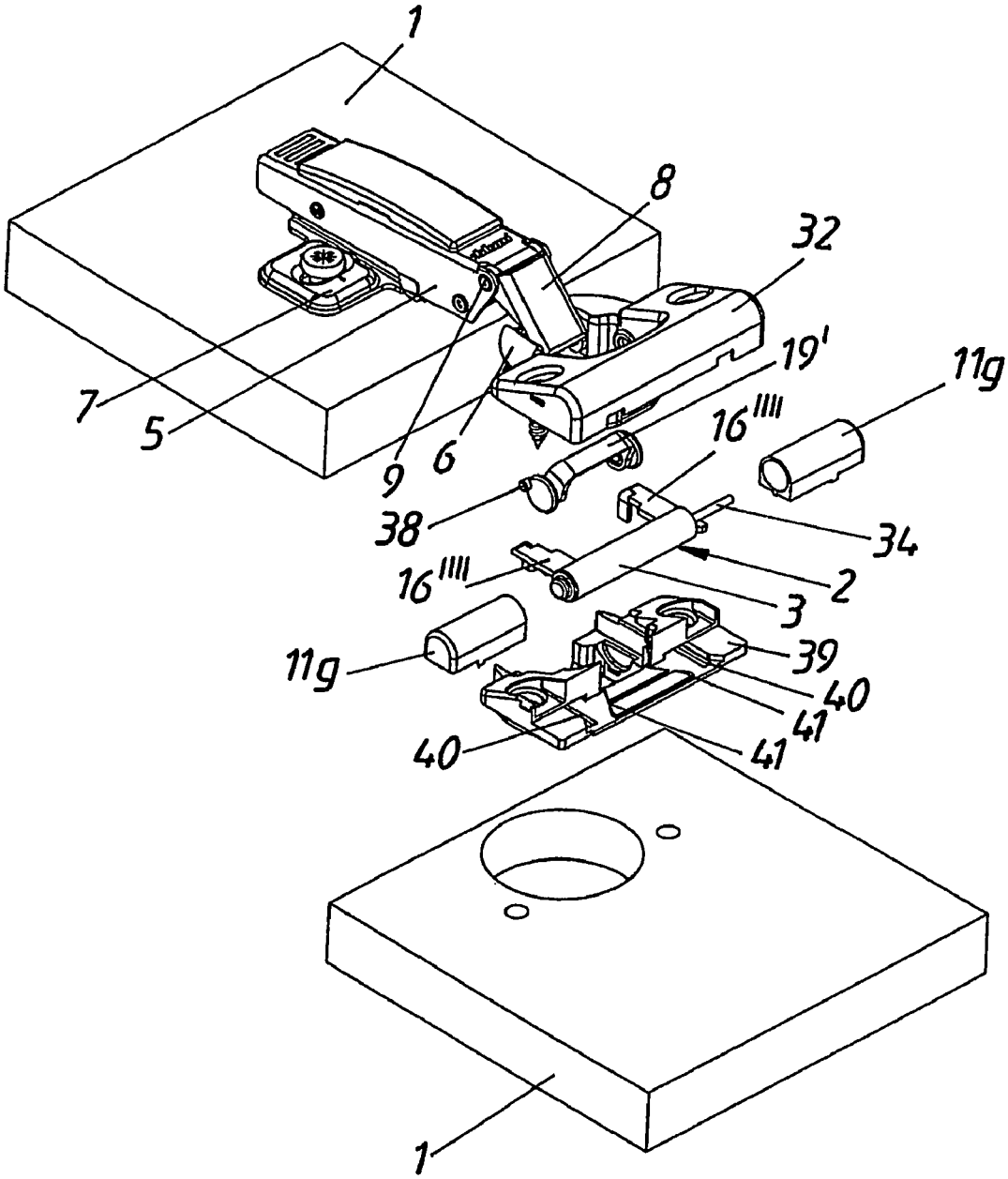
Figure 38:
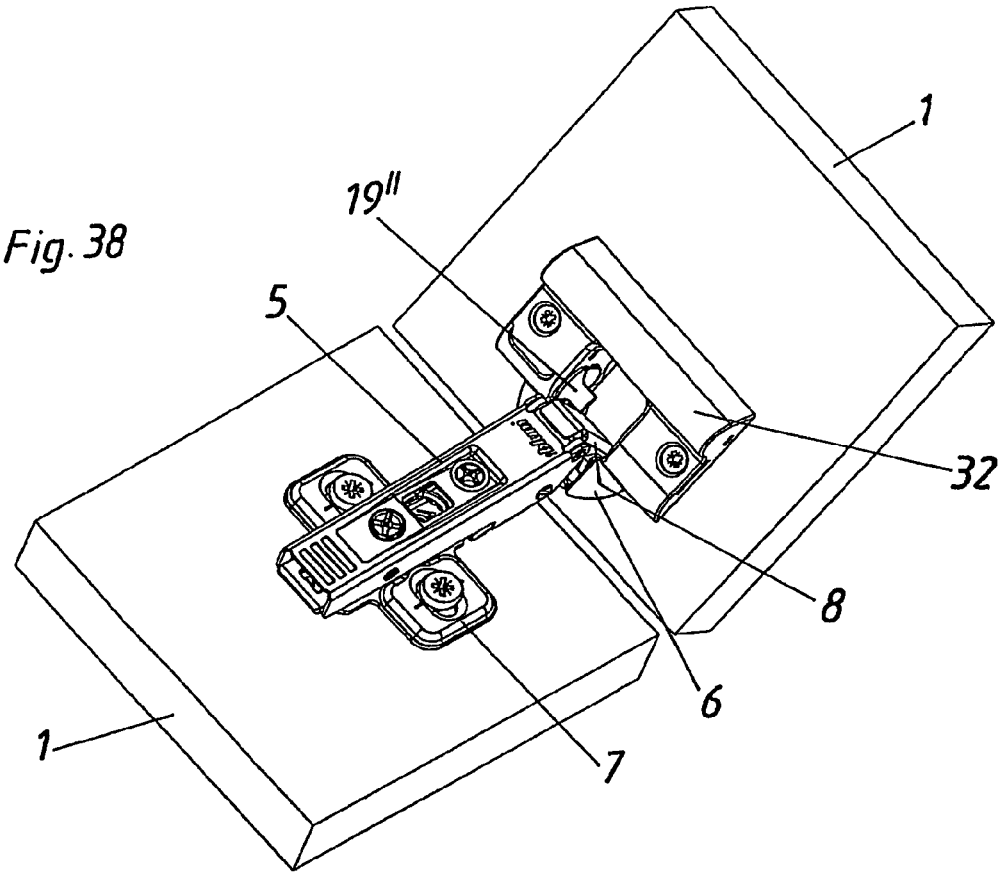
FIGS. 38 through 42 show a ninth embodiment by way of example of the invention.
Figure 39:
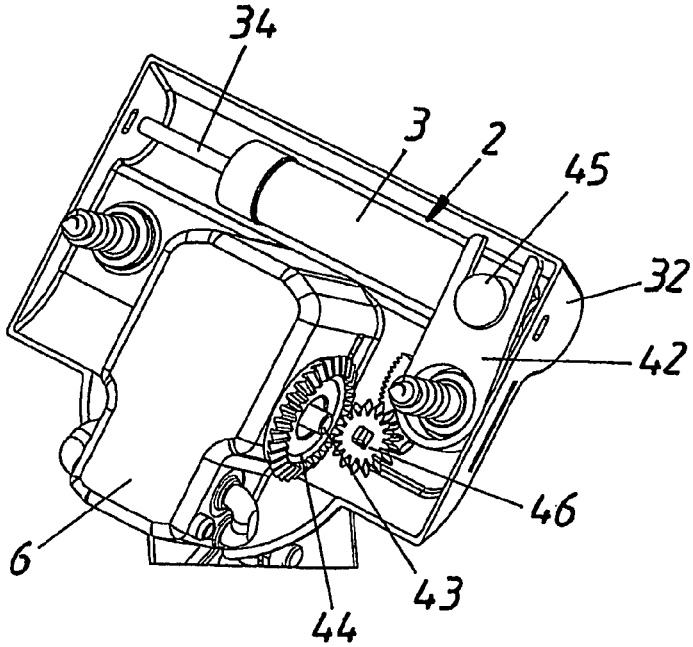
Figure 40:
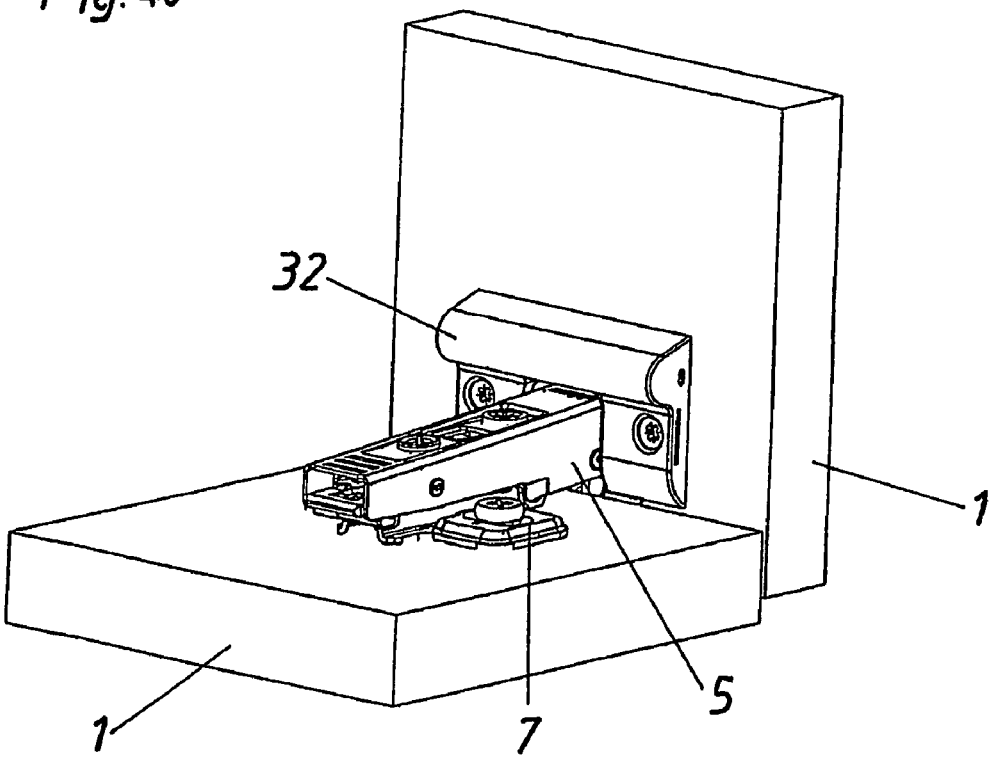

The eighth example according to the invention is shown in FIGS. 32 through 37. FIG. 32 shows an intermediate position just before the hinge lever 8 meets the actuating lever 19' which is arranged in part in the interior of the recess in the hinge cup 6 in order thereby to initiate the beginning of the damping stroke. The damper 2 itself as well as the transmission mechanism associated therewith are concealed under the cover housing 32 in FIG. 32. FIG. 33 shows the same position but with the cover housing 32 removed and with omission of the left-hand housing-like transmission lever 11*g*. FIG. 34 shows the open position of the hinge in which the actuating lever 19' does not touch the hinge lever 8. FIG. 36 shows the closure position without the cover housing 32 but with two housing-like transmission levers 11*g*. FIG. 35 shows in this position a view from below on to the hinge cup 6, wherein the guide plate 39 of the transmission mechanism has been removed. FIG. 37 shows an exploded view of all essential parts of the transmission mechanism. In the damping stroke, in this embodiment, the actuating lever 19' is pivoted by the hinge lever 8 from the position shown in FIG. 32. As a result, the lugs 38 arranged on the actuating lever 19' push the thrust lever 16'" in the direction 49 (along the line or axis of thrust movement). In this case, the thrust levers 16"" are supported at the guide edges 40 of the guide plate 39 and as a result push the inclined guide paths (walls) 21" respectively arranged fixedly on the transmission levers 11*g* towards each other so that accordingly the transmission levers 11*g* directly engaging the damper 2 are also moved towards each other. In that way, the pusher (piston rod) 34 is pressed into the housing (cylinder) 3 of the damper 2 and the damping stroke is implemented. At the end of the closure movement of the hinge and thus at the end of the damping stroke, the thrust levers 16"" bear against the inclined abutment surfaces 41 of the guide plate 39. The inclined abutment surfaces 41 thus represent a limitation in respect of the maximum thrust movement of the thrust levers 16"". When the hinge is moved back into the open position shown in FIG. 34 again, the return spring present in the damper itself performs the return stroke movement, upon relief of load of the actuating lever 19'. In which case, the transmission levers 11*g* are again urged away from each other and thus the thrust levers 16"" are moved in opposite relationship to the direction 49 (again, along the line or axis of thrust movement) into their retracted starting position again.

Figure 41:
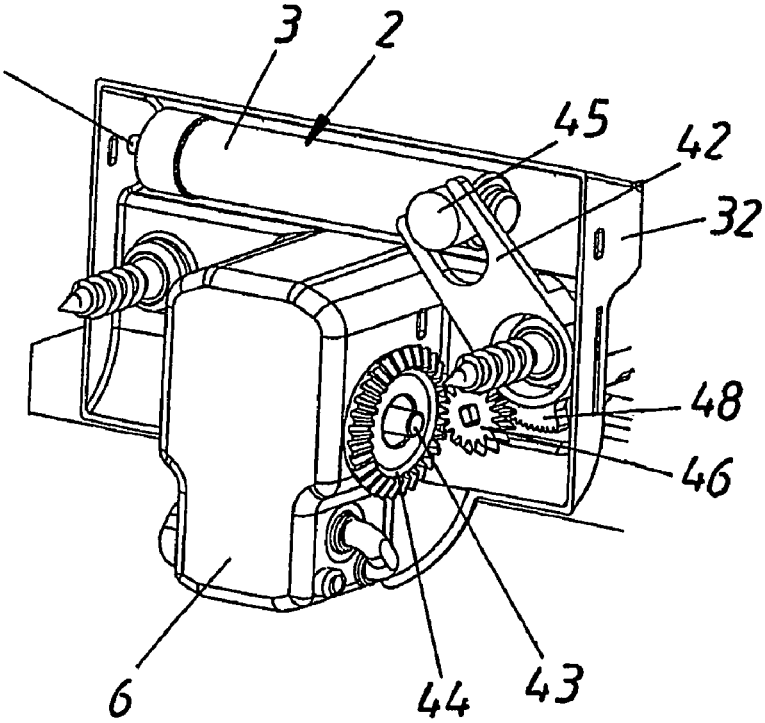
Figure 42:
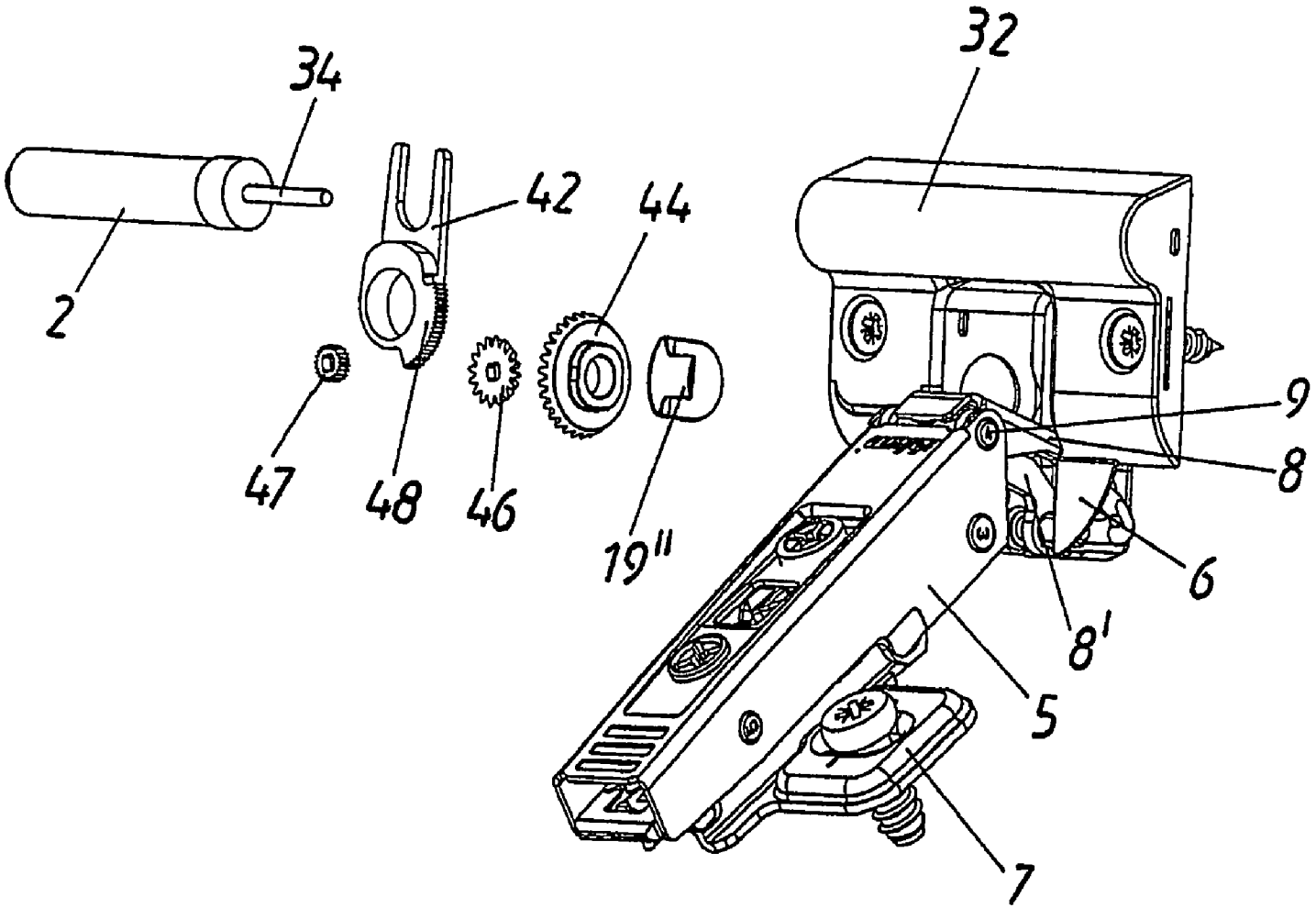
Figure 43:
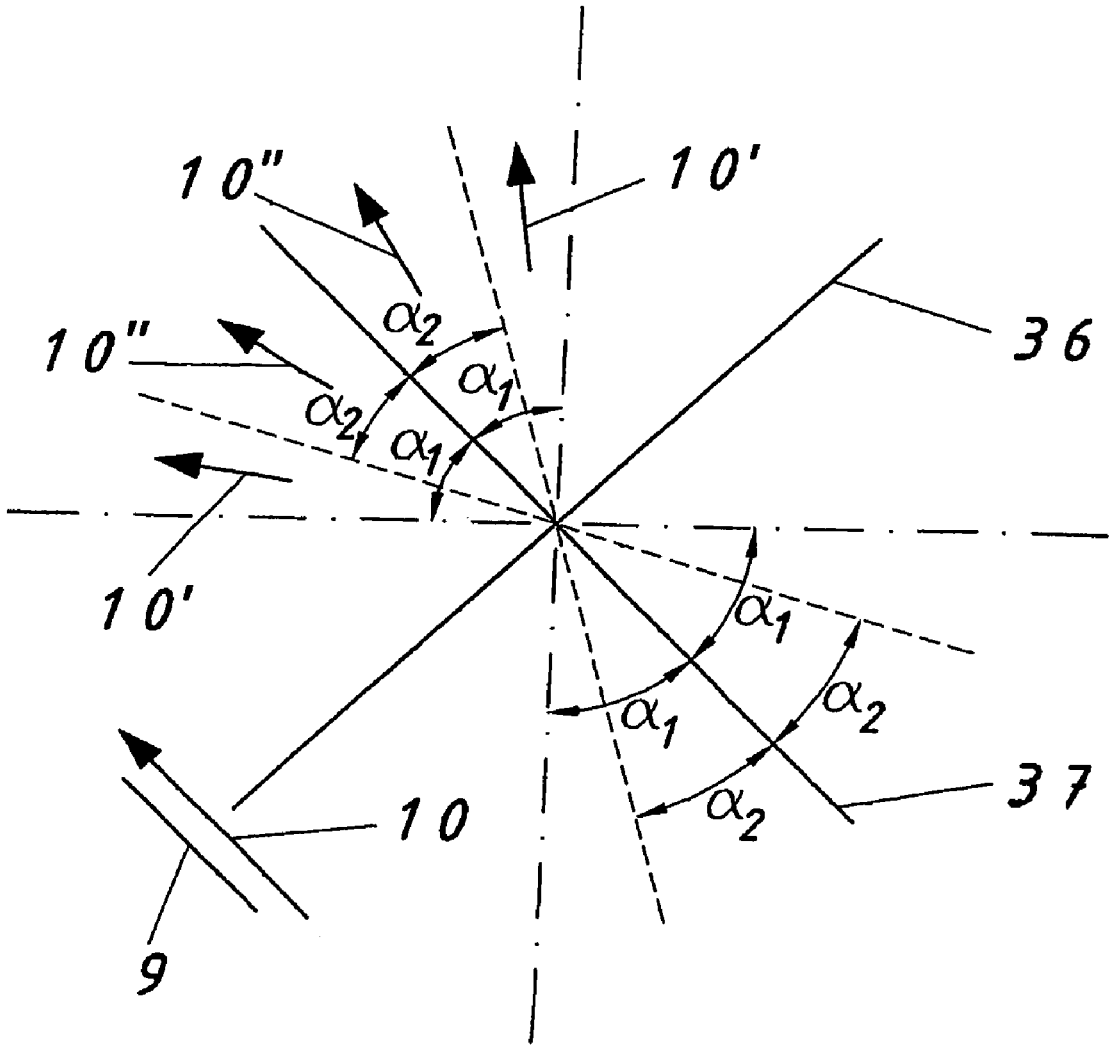
FIG. 43 shows a sketch relating to angular ranges according to the invention between the direction of the damping stroke and the hinge axis or axes.

In the embodiment of the invention according to FIGS. 38 through 42, the transmission mechanism has a gear transmission in the form of a bevel gear transmission. In the illustrated embodiment, this is formed by two interengaging bevel gears 44 and 46 and by way of the spur gear 47 connected coaxially and non-rotatably to the second bevel gear 46, and the toothed sector 48. The latter is non-rotatably connected to the forked pivoted lever 42 which in turn is connected by way of the pin 45 to the housing 3 of the damper 2. Provided for actuation of the bevel gear transmission is an actuating lever 19" which is arranged at least partially in the interior of the hinge cup 16 and which in the closure operation is acted upon and pivoted by the hinge lever 8 shortly after the position shown in FIG. 38. The resulting rotary movement is transmitted to the first bevel gear 44 by way of the common axis 43. That causes rotation of the second bevel gear 46 which is in engagement therewith and the spur gear 47 which is non-rotatably connected thereto and which in turn engages into the toothed sector 48 and thus pivots the forked pivoted lever 42 in such a way that this results in the piston rod 34 supported on the cover housing 32 being pressed into the housing 3 and thus resulting in a damping stroke on the part of the damper 2. The end of the damping stroke is reached in the closure position of the hinge shown in FIG. 40. FIG. 41 shows the pusher (piston rod) 34 of the damper 2, which in this position is pushed almost completely into the housing (cylinder) 3.

When the hinge is opened, the return stroke is again initiated by way of a return spring (not visible here) arranged in the damper 2 itself. At the end of the return stroke the damper is again in the position shown in FIG. 39.

All embodiments avoid having the housing 3 and/or the pusher 4 and/or the piston rod 34 of the damper 2 perform a rotational movement in the damping stroke and/or in the return stroke. All embodiments, both in the damping stroke and also in the return stroke, ensure that the components move exclusively with a translatory or linear movement. That avoids wear in the components of the damper by virtue of the components turning relative to each other. In the case of most embodiments, it is beneficially also provided in that sense that at least one and preferably all transmission levers which directly engage the housing and/or a pusher and/or a piston rod of the damper performs or perform an exclusively translatory or linear movement in the damping stroke and/or in the return stroke of the damper.

FIG. 43 shows once again the angular ranges which are possible in accordance with the invention for the directions 10, 10', 10" of the damping stroke (i.e., line or axis of damping movement) in relation to the course of the hinge axis 9. All directions (lines of movement) parallel to the perpendicular line or axis 36 to a line 37 parallel to the hinge axis 9 are excluded. The angular ranges $\alpha_1$ with at least 45° and $\alpha_2$ with at least 60° relative to the perpendicular 36 are preferred. The maximum space saving is achieved with directions 10 for the damping stroke in parallel relationship with the hinge axis 9.

The invention claimed is:

1. A hinge including a damper arrangement, said hinge having two parts pivotably connecting to each other, said damper arrangement comprising:

a linear damper configured to have a linear damping stroke;

at least two abutment portions to be respectively mounted to one of the parts of the hinge, said at least two abutment portions being pivotably connected together by the hinge having a hinge axis, said damper being arranged such that a direction of the linear damping stroke is at a damping stroke angle relative to a line parallel to said hinge axis, said damping stroke angle being different than a perpendicular angle between the line parallel to said hinge axis and a line perpendicular to said hinge axis;

a transmission mechanism, wherein said hinge pivotably connecting said abutment portions includes a hinge lever for triggering the linear damping stroke via said transmission mechanism, said hinge lever and said transmission mechanism being configured such that said hinge lever triggers the linear damping stroke during pivotal movement of said at least two abutment portions; and a transmission lever, a thrust lever, and an actuating lever, said transmission lever arranged to be acted upon by said hinge lever via said transmission lever, said thrust lever, and said actuating lever.

2. The damper arrangement of claim 1, wherein said linear damper is arranged so that the direction of the linear damping stroke is substantially parallel to said hinge axis.

3. The damper arrangement of claim 1, wherein said damper is arranged so that an angle between the direction of the linear damping stroke and the line perpendicular to said hinge axis is at least 45°.

4. The damper arrangement of claim 1, wherein said damper is arranged so that an angle between the direction of the linear damping stroke and the line perpendicular to said hinge axis is at least 60°.

5. The damper arrangement of claim 1, wherein said abutment portions and said hinge are components of a furniture hinge.

6. The damper arrangement of claim 1, wherein a first one of said at least two abutment portions comprises a hinge cup or a hinge arm.

7. The damper arrangement of claim 1, wherein a first one of said at least two abutment portions comprises a hinge cup, and a second one of said abutment portions comprises a hinge arm.

8. The damper arrangement of claim 1, wherein said at least two abutment portions include a hinge cup, said damper being arranged at said hinge cup.

9. The damper arrangement of claim 1, wherein one of said at least two abutment portions comprises a hinge cup, said transmission mechanism being arranged at said hinge cup.

10. The damper arrangement of claim 1, wherein said transmission mechanism includes a tension cable.

11. The damper arrangement of claim 1, wherein said transmission mechanism has a tong configuration for engaging said linear damper.

12. The damper arrangement of claim 1, wherein said transmission mechanism comprises a transmission lever engaging said linear damper and a rotational body to be acuated by said hinge lever, said transmission lever being operable to engage a screw-shaped guide path of said rotational body.

13. The damper arrangement of claim 1, wherein said transmission mechanism comprises said thrust lever to be actuated by said hinge lever, said thrust lever engaging said transmission lever engaging said linear damper, said transmission lever engaging said linear damper via a guide path oriented at an incline relative to a direction of actuation of said thrust lever.

14. The damper arrangement of claim 1, wherein said transmission mechanism comprises a gear transmission.

15. The damper arrangement of claim 1, wherein said linear damper is configured to perform a damping stroke when two damper components are pushed together or when two damper components are pulled away from each other.

16. The damper arrangement of claim 1, wherein said linear damper comprises a housing and a pusher operable to move with respect to said housing, said housing and said pusher being configured to perform an exclusively linear movement during the damping stroke of said linear damper.

17. The damper arrangement of claim 1, wherein said housing comprises a cylinder, and said pusher comprises a piston arranged in said cylinder.

18. The damper arrangement of claim 1, wherein said linear damper comprises a housing and a pusher arranged in said housing, further comprising a transmission lever directly engaging at least one of said housing and said pusher of said damper to perform an exclusively linear movement during the damping stroke.

19. The damper arrangement of claim 7, wherein said at least two abutment portions further include a hinge lever, said damper arrangement further comprising a transmission mechanism including a thrust lever configured to be urged by said hinge lever.

20. The damper arrangement of claim 10, wherein said tension cable and said hinge lever are arranged such that said tension cable can be pressed by said hinge lever into a recess of one of said at least two abutment portions.

21. The damper arrangement of claim 11, wherein said transmission mechanism comprises two transmission levers hinged together so as to have said tong configuration for engaging said linear damper.

22. The damper arrangement of claim 13, wherein a pivotable actuating lever is arranged between said hinge lever and said thrust lever.

23. The damper arrangement of claim 14, wherein said gear transmission comprises a bevel gear transmission.

24. The damper arrangement of claim 14, wherein said gear transmission comprises a forked pivotable lever engaging said linear damper.

25. The damper arrangement of claim 14, wherein said transmission mechanism further includes a pivotable actuating lever for transmission of a movement of said hinge lever to said gear transmission.

26. The damper arrangement of claim 21, wherein said transmission mechanism comprises a thrust lever arranged to be supported against said hinge lever, and configured to engage a hinge connection of said transmission levers.

27. The damper arrangement of claim 22, wherein a first one of said at least two abutment portions comprises a hinge cup, said pivotable actuating lever being arranged at least partially in an interior of said hinge cup.

28. The damper arrangement of claim 22, wherein said transmission mechanism further includes an actuating lever having a pin for actuation of said thrust lever.

29. The damper arrangement of claim 23, wherein said bevel gear transmission comprises at least two mutually engaging bevel gears.

30. The damper arrangement of claim 25, wherein a first one of said at least two abutment portions comprises a hinge cup, said pivotable actuating lever being arranged at least partially in an interior of said hinge cup.

* * * * *